US006447465B1

(12) United States Patent
Sherman et al.

(10) Patent No.: US 6,447,465 B1
(45) Date of Patent: Sep. 10, 2002

(54) CPR DEVICE WITH COUNTERPULSION MECHANISM

(75) Inventors: Darren R. Sherman; Kenneth H. Mollenauer, both of Portola Valley, CA (US)

(73) Assignee: Revivant Corporation, Sunnyvale, CA (US)

( * ) Notice: Subject to any disclaimer, the term of this patent is extended or adjusted under 35 U.S.C. 154(b) by 0 days.

(21) Appl. No.: 09/189,417

(22) Filed: Nov. 10, 1998

(51) Int. Cl.[7] ..... A61H 31/00
(52) U.S. Cl. ..... 601/41; 601/44
(58) Field of Search ..... 601/41–44; 128/202.19, 128/204.18; 606/201, 202

(56) References Cited

U.S. PATENT DOCUMENTS

| | | | | |
|---|---|---|---|---|
| 2,071,215 A | | 2/1937 | Petersen | |
| 2,699,163 A | | 1/1955 | Engstrom | |
| 2,754,817 A | | 7/1956 | Nemeth | |
| 2,780,222 A | | 2/1957 | Polzin et al. | |
| 2,853,998 A | | 9/1958 | Emerson | |
| 2,899,955 A | | 8/1959 | Huxley, III et al. | |
| 3,042,024 A | | 7/1962 | Mendelson | |
| 3,120,228 A | | 2/1964 | Huxley, III | |
| 3,368,550 A | | 2/1968 | Glascock | |
| 3,461,860 A | | 8/1969 | Barkalow et al. | |
| 3,481,327 A | | 12/1969 | Drennen | |
| 3,782,371 A | | 1/1974 | Dorouineau | |
| 4,004,579 A | * | 1/1977 | Dedo | 601/41 |
| 4,349,015 A | | 9/1982 | Alferness | |
| 4,397,306 A | | 8/1983 | Weisfeldt et al. | |
| 4,424,806 A | * | 1/1984 | Newman et al. | |
| 4,570,615 A | | 2/1986 | Barkolow | |
| 4,664,098 A | | 5/1987 | Woudenberg et al. | |
| 4,770,164 A | | 9/1988 | Lach et al. | |
| 4,915,095 A | | 4/1990 | Chun | |
| 4,928,674 A | | 5/1990 | Halperin et al. | |
| 5,056,505 A | | 10/1991 | Warwick et al. | |
| 5,098,369 A | | 3/1992 | Heilman et al. | 600/16 |
| 5,184,606 A | | 2/1993 | Csorba | |
| 5,217,010 A | | 6/1993 | Tsitlik et al. | |
| 5,222,478 A | | 6/1993 | Scarberry et al. | |
| 5,257,619 A | | 11/1993 | Everete | |
| 5,277,194 A | | 1/1994 | Hosterman et al. | |
| 5,295,481 A | | 3/1994 | Geeham | 601/43 |
| 5,327,887 A | | 7/1994 | Nowakowski | 128/204.21 |
| 5,359,999 A | | 11/1994 | Kinsman | 128/204.21 |
| 5,370,603 A | | 12/1994 | Newman | 601/41 |
| 5,399,148 A | | 3/1995 | Waide et al. | 601/41 |
| 5,405,362 A | | 4/1995 | Kramer | 607/5 |
| 5,474,533 A | | 12/1995 | Ward et al. | 604/26 |
| 5,490,820 A | | 2/1996 | Schock et al. | 601/41 |
| 5,630,789 A | | 5/1997 | Schock et al. | 601/41 |
| 5,664,563 A | | 9/1997 | Schroeder et al. | 128/204.25 |
| 5,738,637 A | | 4/1998 | Kelly et al. | 601/41 |
| 5,806,512 A | * | 9/1998 | Abramov | |

FOREIGN PATENT DOCUMENTS

| | | |
|---|---|---|
| WO | 9722327 | 6/1997 |

* cited by examiner

*Primary Examiner*—Danton D. DeMille
(74) *Attorney, Agent, or Firm*—K. David Crockett, Esq.; Crockett & Crockett

(57) ABSTRACT

A system for performing chest compression and abdominal compression for Cardiopulmonary Resuscitation. The system includes a motor and gearbox including a system of clutches and brakes which allow for controlling and limiting the movement of compressing mechanisms operating on the chest and the abdomen of a patient.

3 Claims, 26 Drawing Sheets

| TIME | 1 | 2 | 3 | 4 | 5 | 6 | 7 | 8 | 9 | 10 | 11 | 12 |
|---|---|---|---|---|---|---|---|---|---|---|---|---|
| MOTOR | ON | ON | ON | ON | ON | ON | ON | ON | ON | ON | ON | OFF |
| CLUTCH | ON | OFF | ON | OFF | ON(OFF) | OFF | ON | OFF | OFF | OFF | ON | OFF |
| BRAKE | | | | | | | | | | | | |

| | 1 | 2 | 3 | 4 | 5 | 6 | 7 | 8 | 9 | 10 | 11 | 12 |
|---|---|---|---|---|---|---|---|---|---|---|---|---|
| MOTOR | FWD | OFF | REV(OFF) | OFF | FWD | OFF | REV(OFF) | REV(OFF) | FWD(OFF) | OFF | REV | OFF |
| CAM BRAKE | OFF | ON | OFF(ON) | ON | OFF | ON | OFF(ON) | ON | OFF(ON) | ON | OFF | ON |
| CLUTCH | ON | ON | ON | ON | ON | ON | ON | ON | ON | ON | ON | ON |

| TIME | 1 | 2 | 3 | 4 | 5 | 6 | 7 | 8 | 9 | 10 | 11 | 12 | 13 |
|---|---|---|---|---|---|---|---|---|---|---|---|---|---|
| MOTOR | ON | OFF | ON | ON | ON(OFF) | OFF | ON | ON | ON | ON | ON | ON | ON |
| CLUTCH | ON | ON | OFF | OFF | ON | ON | OFF | OFF | ON | ON | OFF | OFF | ON |
| BRAKE | OFF | ON | OFF | OFF | OFF(ON) | ON | OFF | OFF | OFF | OFF | OFF | OFF | OFF |

| TIME | 1 | 2 | 3 | 4 | 5 | 6 | 7 | 8 | 9 | 10 | 11 | 12 |
|---|---|---|---|---|---|---|---|---|---|---|---|---|
| MOTOR | ON | OFF | OFF | OFF | ON | OFF | OFF | OFF | ON | OFF | ON | ON |
| CLUTCH | ON | ON | OFF(ON) | ON | ON | ON | OFF(ON) | ON | ON | ON | OFF | OFF |
| CAM BRAKE | OFF | ON | ON | ON | OFF | ON | ON | ON | OFF(ON) | OFF(ON) | OFF | OFF |

| TIME | 1 | 2 | 3 | 4 | 5 | 6 | 7 | 8 | 9 | 10 | 11 | 12 |
|---|---|---|---|---|---|---|---|---|---|---|---|---|
| MOTOR | ON | ON | ON | ON | ON | ON | ON | ON | ON | ON | ON | ON |
| CLUTCH | ON | OFF | OFF | OFF | ON | OFF | OFF | OFF | ON | ON | OFF | OFF |
| SPINDLE BRAKE | OFF | ON | OFF(ON) | ON | OFF | ON | OFF(ON) | ON | OFF | OFF | OFF(ON) | ON |

| TIME | 1 | 2 | 3 | 4 | 5 | 6 | 7 | 8 | 9 | 10 | 11 | 12 |
|---|---|---|---|---|---|---|---|---|---|---|---|---|
| MOTOR | ON | ON | ON | ON | ON | ON | ON | ON | ON | ON | ON | ON |
| CLUTCH | ON | OFF | OFF | OFF | ON | ON(OFF) | OFF | OFF | ON | ON(OFF) | OFF | OFF |
| SPINDLE BRAKE | OFF | OFF | OFF(ON) | ON | OFF | OFF(ON) | OFF(ON) | ON | OFF | OFF(ON) | OFF(ON) | OFF |

| TIME | 1 | 2 | 3 | 4 | 5 | 6 | 7 | 8 | 9 | 10 | 11 | 12 |
|---|---|---|---|---|---|---|---|---|---|---|---|---|
| MOTOR | ON | ON | ON | ON | ON | ON | ON | ON | ON | ON | ON | ON |
| CLUTCH | ON | OFF | OFF | OFF | ON | ON(OFF) | OFF | OFF | ON | ON | OFF | OFF |
| BRAKE | OFF | OFF | OFF(ON) | ON | OFF | OFF(ON) | OFF(ON) | ON | OFF | OFF | OFF(ON) | ON |

| TIME | 1 | 2 | 3 | 4 | 5 | 6 | 7 | 8 | 9 | 10 | 11 | 12 |
|---|---|---|---|---|---|---|---|---|---|---|---|---|
| MOTOR | ON | OFF | ON | ON | ON | OFF | ON | ON | ON | ON | OFF | ON |
| CLUTCH | ON | ON | OFF | OFF | ON | ON | OFF | OFF | ON | ON | OFF | OFF |
| BRAKE | OFF | ON | OFF | ON | OFF | ON | OFF | OFF | OFF | OFF | ON | OFF |
| SPINDLE BRAKE | OFF | OFF | OFF | ON | OFF | OFF | OFF | ON | OFF | OFF | OFF | ON |

| | 1 | 2 | 3 | 4 | 5 | 6 | 7 | 8 | 9 | 10 | 11 | 12 |
|---|---|---|---|---|---|---|---|---|---|---|---|---|
| MOTOR | ON | OFF | ON(OFF) | OFF | ON | OFF | ON | OFF | ON | OFF | ON | OFF |
| CAM BRAKE | OFF | ON | OFF(ON) | ON | OFF | ON | OFF(ON) | ON | OFF(ON) | ON | OFF | ON |
| CLUTCH | ON | ON | ON | ON | ON | ON | ON | ON | ON | ON | ON | ON |

FIG.27

| TIME | 1 | 2 | 3 | 4 | 5 | 6 | 7 | 8 | 9 | 10 | 11 | 12 |
|---|---|---|---|---|---|---|---|---|---|---|---|---|
| MOTOR | ON | ON | ON | ON | ON | ON | ON | ON | ON | ON | OFF | ON |
| CLUTCH | ON | ON | OFF | OFF | ON | OFF | OFF | OFF | ON | ON/OFF | OFF | OFF |
| BRAKE | OFF | OFF | OFF/ON | ON | OFF | ON | OFF/ON | ON | OFF | OFF/ON | OFF | OFF |
| ab CLUTCH | OFF | OFF | ON/OFF | OFF | OFF | OFF | ON/OFF | OFF | OFF | OFF | ON/OFF | OFF |
| ab BRAKE | OFF | OFF | OFF/ON | ON | OFF | OFF | OFF/ON | OFF | OFF | OFF | OFF/ON | ON |

FIG.28

| TIME | 1 | 2 | 3 | 4 | 5 | 6 | 7 | 8 | 9 | 10 | 11 | 12 |
|---|---|---|---|---|---|---|---|---|---|---|---|---|
| CHEST MOTOR | ON | ON | ON | ON | ON | ON | ON | ON | ON | ON | OFF | ON |
| ab MOTOR | ON | ON | ON | ON | ON | ON | ON | ON | ON | ON | OFF | ON |
| CLUTCH | ON | ON | OFF | OFF | ON | ON/OFF | OFF | OFF | ON | OFF | OFF | OFF |
| BRAKE | OFF | OFF | OFF/ON | ON | OFF | OFF/ON | OFF/ON | ON | OFF | ON | OFF/ON | ON |
| ab CLUTCH | OFF | OFF | ON/OFF | OFF | OFF | OFF | ON/OFF | OFF | OFF | OFF | ON/OFF | OFF |
| ab BRAKE | OFF | OFF | OFF/ON | ON | OFF | OFF | OFF/ON | ON | ON | ON | OFF | OFF |

CPR DEVICE WITH COUNTERPULSION MECHANISM

FIELD OF THE INVENTION

This invention relates to the resuscitation of cardiac arrest patients.

BACKGROUND OF THE INVENTION

Cardiopulmonary resuscitation (CPR) is a well known and valuable method of first aid. CPR is used to resuscitate people who have suffered from cardiac arrest after heart attack, electric shock, chest injury and many other causes. During cardiac arrest, the heart stops pumping blood, and a person suffering cardiac arrest will soon suffer brain damage from lack of blood supply to the brain. Thus, CPR requires repetitive chest compression to squeeze the heart and the thoracic cavity to pump blood through the body. Very often, the patient is not breathing, and mouth to mouth artificial respiration or a bag valve mask is used to supply air to the lungs while the chest compression pumps blood through the body.

It has been widely noted that CPR and chest compression can save cardiac arrest patients, especially when applied immediately after cardiac arrest. Chest compression requires that the person providing chest compression repetitively push down on the sternum of the patient at 80 –100 compressions per minute. CPR and closed chest compression can be used anywhere, wherever the cardiac arrest patient is stricken. In the field, away from the hospital, it may be accomplished by ill-trained by-standers or highly trained paramedics and ambulance personnel.

When a first aid provider performs chest compression well, blood flow in the body is typically about 25–30% of normal blood flow. This is enough blood flow to prevent brain damage. However, when chest compression is required for long periods of time, it is difficult if not impossible to maintain adequate compression of the heart and rib cage. Even experienced paramedics cannot maintain adequate chest compression for more than a few minutes. Hightower, et al., Decay In Quality Of Chest Compressions Over Time, 26 Ann. Emerg. Med. 300 (September 1995). Thus, long periods of CPR, when required, are not often successful at sustaining or reviving the patient. At the same time, it appears that, if chest compression could be adequately maintained, cardiac arrest patients could be sustained for extended periods of time. Occasional reports of extended CPR efforts (45–90 minutes) have been reported, with the patients eventually being saved by coronary bypass surgery. See Tovar, et al., Successful Myocardial Revascularization and Neurologic Recovery, 22 Texas Heart J. 271 (1995).

In efforts to provide better blood flow and increase the effectiveness of bystander resuscitation efforts, modifications of the basic CPR procedure have been proposed and used. Of primary concern in relation to the devices and methods set forth below are the various mechanical devices proposed for use in main operative activity of CPR, namely repetitive compression of the thoracic cavity.

The device shown in Barkolow, Cardiopulmonary Resuscitator Massager Pad, U.S. Pat. No. 4,570,615 (Feb. 18, 1986), the commercially available Thumper device, and other such devices, provide continuous automatic closed chest compression. Barkolow and others provide a piston which is placed over the chest cavity and supported by an arrangement of beams. The piston is placed over the sternum of a patient and set to repeatedly push downward on the chest under pneumatic power. The patient must first be installed into the device, and the height and stroke length of the piston must be adjusted for the patient before use, leading to delay in chest compression. Other analogous devices provide for hand operated piston action on the sternum. Everette, External Cardiac Compression Device, U.S. Pat. No. 5,257,619 (Nov. 2, 1993), for example, provides a simple chest pad mounted on a pivoting arm supported over a patient, which can be used to compress the chest by pushing down on the pivoting arm. These devices are not clinically more successful than manual chest compression. See Taylor, et al., External Cardiac Compression, A Randomized Comparison of Mechanical and Manual Techniques, 240 JAMA 644 (August 1978).

Other devices for mechanical compression of the chest provide a compressing piston which is secured in place over the sternum via vests or straps around the chest. Woudenberg, Cardiopulmonary Resuscitator, U.S. Pat. No. 4,664,098 (May 12, 1987) shows such a device which is powered with an air cylinder. Waide, et al., External Cardiac Massage Device, U.S. Pat. No. 5,399,148 (Mar. 21, 1995) shows another such device which is manually operated. In another variation of such devices, a vest or belt designed for placement around the chest is provided with pneumatic bladders which are filled to exert compressive forces on the chest. Scarberry, Apparatus for Application of Pressure to a Human Body, U.S. Pat. No. 5,222,478 (Jun. 29, 1993) and Halperin, Cardiopulmonary Resuscitation and Assisted Circulation System, U.S. Pat. No. 4,928,674 (May 29, 1990) show examples of such devices. Lach, et al., Resuscitation Method and Apparatus, U.S. Pat. No. 4,770,164 (Sep. 13, 1988) proposed compression of the chest with wide band and chocks on either side of the back, applying a side-to-side clasping action on the chest to compress the chest.

Several operating parameters must be met in a successful resuscitation device. Chest compression must be accomplished vigorously if it is to be effective. Very little of the effort exerted in chest compression actually compresses the heart and large arteries of the thorax and most of the effort goes into deforming the chest and rib cage. The force needed to provide effective chest compression creates risk of other injuries. It is well known that placement of the hands over the sternum is required to avoid puncture of the heart during CPR. Numerous other injuries have been caused by chest compression. See Jones and Fletter, Complications After Cardiopulmonary Resuscitation, 12 AM. J. Emerg. Med. 687 (November 1994), which indicates that lacerations of the heart, coronary arteries, aortic aneurysm and rupture, fractured ribs, lung herniation, stomach and liver lacerations have been caused by CPR. Thus the risk of injury attendant to chest compression is high, and clearly may reduce the chances of survival of the patient vis-a-vis a resuscitation technique that could avoid those injuries. Chest compression will be completely ineffective for very large or obese cardiac arrest patients because the chest cannot be compressed enough to cause blood flow. Chest compression via pneumatic devices is hampered in its application to females due to the lack of provision for protecting the breasts from injury and applying compressive force to deformation of the thoracic cavity rather than the breasts.

CPR and chest compression should be initiated as quickly as possible after cardiac arrest to maximize its effectiveness and avoid neurologic damage due to lack of blood flow to the brain. Hypoxia sets in about two minutes after cardiac arrest, and brain damage is likely after about four minutes without blood flow to the brain, and the severity of neurologic defect increases rapidly with time. A delay of two or three minutes significantly lowers the chance of survival and increases the probability and severity of brain damage. However, CPR and ACLS are unlikely to be provided within this time frame. Response to cardiac arrest is generally considered to occur in four phases, including action by Bystander CPR, Basic Life Support, Advanced Cardiac Life Support, and the Emergency Room. By-stander CPR occurs, if at all, within the first few minutes after cardiac arrest. Basic Life Support is provided by First Responders who arrive on scene about 4–6 minutes after being dispatched to the scene. First responders include ambulance personnel, emergency medical technicians, firemen and police. They are generally capable of providing CPR but cannot provide drugs or intravascular access, defibrillation or intubation. Advanced Life Support is provided by paramedics or nurse practitioners who generally follow the first responders and arrive about 8–15 minutes after dispatch. ALS is provided by paramedics, nurse practitioners or emergency medical doctors who are generally capable of providing CPR, drug therapy including intravenous drug delivery, defibrillation and intubation. The ALS providers may work with a patient for twenty to thirty minutes on scene before transporting the patient to a nearby hospital. Though defibrillation and drug therapy is often successful in reviving and sustaining the patient, CPR is often ineffective even when performed by well trained first responders and ACLS personnel because chest compression becomes ineffective when the providers become fatigued. Thus, the initiation of CPR before arrival of first responders is critical to successful life support. Moreover, the assistance of a mechanical chest compression device during the Basic Life Support and Advanced Life Support stages is needed to maintain the effectiveness of CPR.

Our own CPR devices use a compression belt around the chest of the patient which is repetitively tightened and relaxed through the action of a belt tightening spool powered by an electric motor. The motor is controlled by control system which times the compression cycles, limits the torque applied by the system (thereby limiting the power of the compression applied to the victim), provides for adjustment of the torque limit based on biological feedback from the patient, provides for respiration pauses, and controls the compression pattern through an assembly of clutches and/or brakes connecting the motor to the belt spool. Our devices have achieved high levels of blood flow in animal studies.

Additional activities undertaken during CPR can promote its effectiveness. Abdominal binding is a technique used to enhance the effectiveness of the CPR chest compression. Abdominal binding is achieved by binding the stomach during chest compression to limit the waste of compressive force which is lost to deformation of the abdominal cavity caused by the compression of the chest. It also inhibits flow of blood into the lower extremities (and thus promotes bloodflow to the brain). Alferness, Manually-Actuable CPR apparatus, U.S. Pat. No. 4,349,015 (Sept. 14, 1982) provides for abdominal restraint during the compression cycle with a bladder that is filled during compression. Counterpulsion is a method in which slight pressure is applied to the abdomen in between each chest compression. A manual device for counterpulsion is shown in Shock, et al., Active Compression/Decompression Device for Cardiopulmonary Resuscitation, U.S. Pat. No. 5,630,789 (May 20, 1997). This device is like a seesaw mounted over the chest with a contact cup on each end of the seesaw. One end of the seesaw is mounted over the chest, and the other end is mounted over the abdomen, and the device is operated by rocking back and forth, alternately applying downward force on each end.

SUMMARY

The devices described below provide for circumferential chest compression with a device which is compact, portable or transportable, self-powered with a small power source, and easy to use by by-standers with little or no training. The devices may also provide for abdominal binding and/or counterpulsion through circumferential abdominal compression. Additional features may also be provided in the device to take advantage of the power source and the structural support board contemplated for a commercial embodiment of the device.

The device includes a broad belt which wraps around the chest and is buckled in the front of the cardiac arrest patient. The belt is repeatedly tightened around the chest to cause the chest compression necessary for CPR. The buckle may include an interlock which must be activated by proper attachment before the device will activate, thus preventing futile belt cycles. The operating mechanism for repeatedly tightening the belt is provided in a small box locatable at the patient's side, and comprises a rolling mechanism which takes up the intermediate length of the belt to cause constriction around the chest. The roller is powered by a small electric motor, and the motor powered by batteries and/or standard electrical power supplies such as 120V household electrical sockets or 12V DC automobile power sockets (car cigarette lighter sockets). The belt is contained in a cartridge which is easily attached and detached from the motor box. The cartridge itself may be folded for compactness. The motor is connected to the belt through a transmission that includes a cam brake and a clutch, and is provided with a controller which operates the motor, clutch and cam brake in several modes. One such mode provides for limiting belt travel according to a high compression threshold, and limiting belt travel to a low compression threshold. Another such mode includes holding the belt taught against relaxation after tightening the belt, and thereafter releasing the belt. Respiration pauses, during which no compression takes place to permit CPR respiration, can be included in the several modes.

Devices which provide for abdominal binding or counterpulsion described below are made of similar construction to the chest compression mechanism. They are operated through power take-off from the drive shaft of the chest compression mechanism through a drive train which includes various combinations of clutches and brakes. The abdominal compression devices may also be operated with a separate drive train which may share the motor used for chest compression or may use its own motor. The operation of the chest compression device and the abdominal compression device is controlled to accomplish abdominal binding or abdominal counterpulsion in coordination with the chest compressions. The abdominal compression may be performed in synchronization with the chest compressions or in syncopation with the chest compressions. The abdominal compression may be held in a static condition during a series of chest compressions, and abdominal compression can even be performed without accompanying chest compression to create effective blood flow in a patient. Mechanisms and control diagrams which accomplish these functions are described below. Thus, numerous inventions are incorporated into the portable resuscitation device described below.

BRIEF DESCRIPTION OF THE DRAWINGS

FIGS. 27, 27*a* illustrate the timing of the operation of the various system components of the CPR/counterpulsion device illustrated in FIG. 23, for example.

FIGS. 28, 28*a*, illustrate the timing of the operation of the various system components of the CPR/counterpulsion device illustrated in FIG. 23, for example.

DETAILED DESCRIPTION OF THE INVENTION

Figure 1:
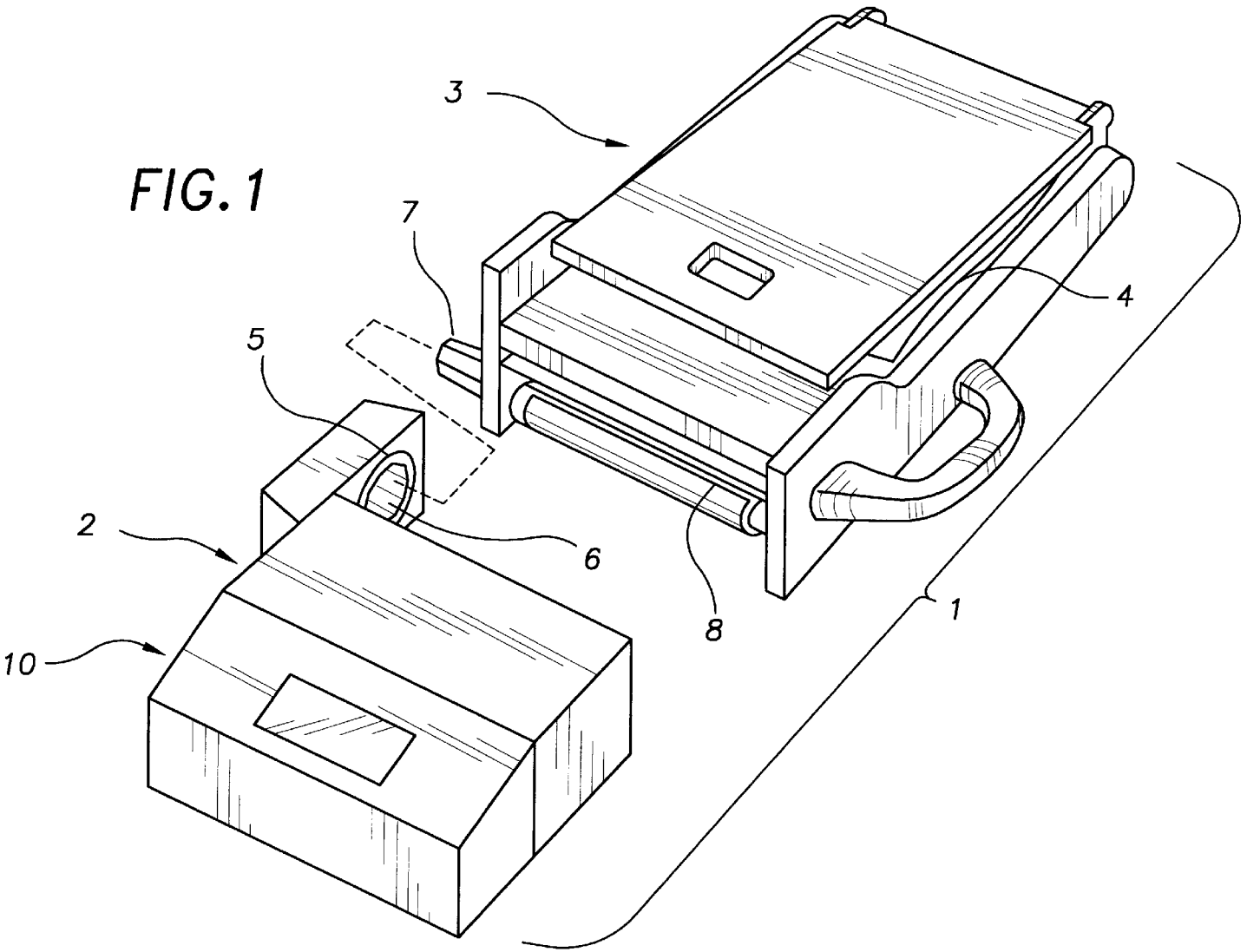
FIG. 1 is an overview of the resuscitation device.

FIG. 1 shows an overview of the resuscitation device 1. The major components are provided in modular form, and include the motor box 2, the belt cartridge 3 and the belt 4. The motor box exterior includes a sprocket 5 in drive wheel 6 which releasable mates with receiving rod 7 on the cartridge. The cartridge houses the belt which will wrap around the chest of the patient. The cartridge also includes the spool 8 which is turned by the receiving rod. The spool takes up the midpoint of the belt to drive the compression cycles. A computer control system 10 may be included as shown in an enclosure mounted on the motor box. By providing the system in modular form, with the motor box releasable attached to the belt cartridge, the belt cartridge may more easily be maneuvered while slipping it under the patient.

Figure 2:
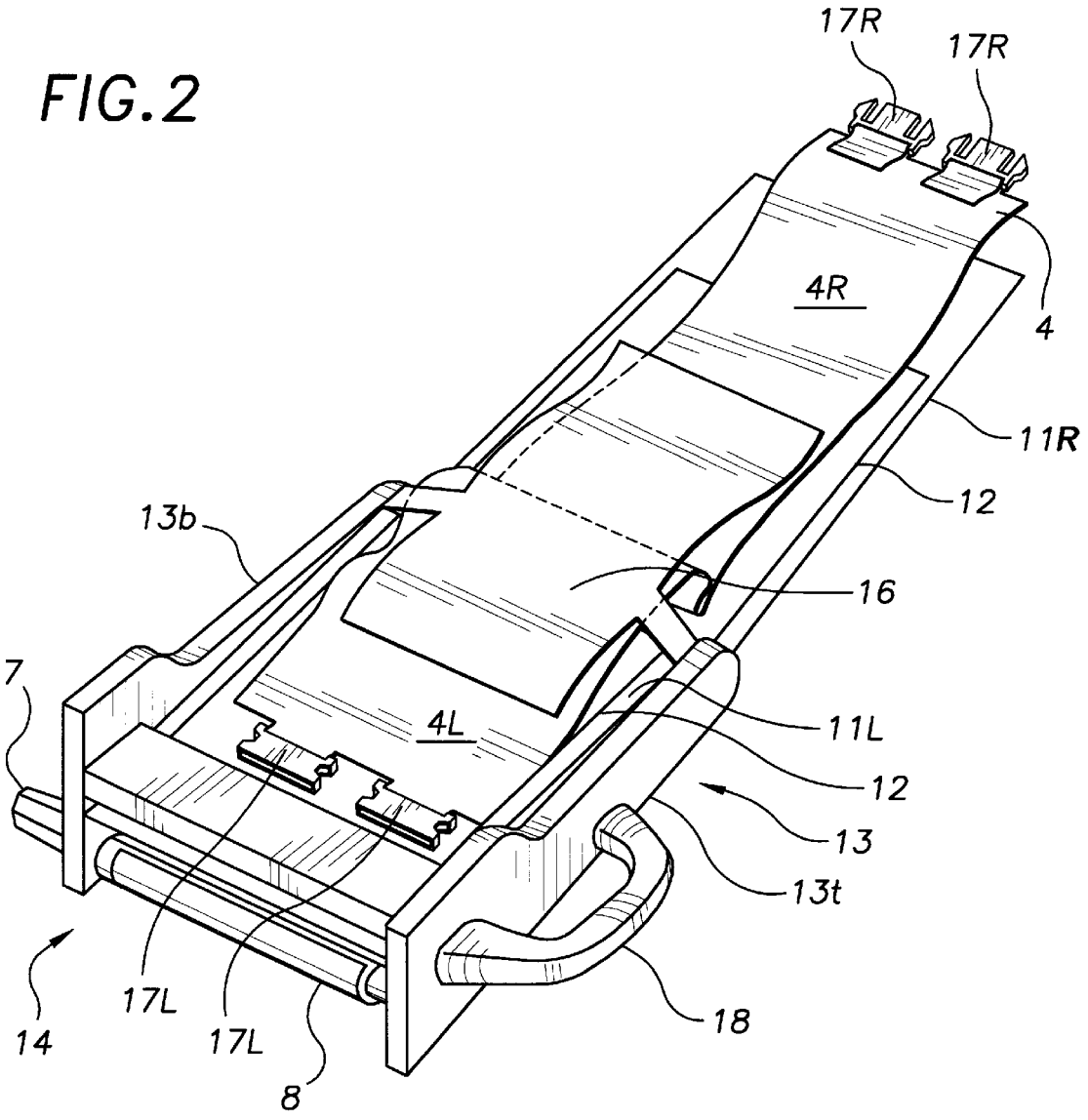
FIG. 2 illustrates the installation of the belt cartridge.

FIG. 2 shows a more detailed view of the cartridge, including the internal mechanisms of the belt cartridge 3. The outer body of the cartridge provides for protection of the belt during storage, and includes a back plate 11 with a left panel 11L and a right panel 11R (relative to the patient during use). The right plate can be folded over the left plate for storage and transport. Both panels are covered with a sheet 12 of low friction material such ad PTFE (Teflon®) to reduce friction when the belt slides over the panel during operation. Under the left panel, the cartridge has a housing 13 which houses the middle portion of the belt, the spool 8 and the spindle 15. The lateral side 14 of the cartridge (corresponding to the anatomic position when in use on a patient) houses the drive spool 8, with its drive rod 7 which engages the drive wheel 6 of the motor box. The cartridge also houses the guide spindle 15 (visible in FIG. 3) for directing the belt toward the drive spool 8. The guide spindle is located near the center of the cartridge (corresponding to the medial line of the patient when in use), so that it is located near the spine when the device is in use. This spindle reverses the belt travel for the left side of the belt, so that when it is pulled to the left by the drive spool, the portion that wraps around the left flank of the body moves to the right. The cartridge body is also hinged near the mid-line, and in this view the cartridge is hinged near the axis of the spindle. A friction liner 16 is suspended over the belt in the area of the guide spindle, and is attached to the housing at the top and bottom panels 13*t* and 13*b* and spans the area in which the left belt portions and right belt portions diverge from the cartridge. The belt 4 is shown in the open condition. Male quick release fittings 17R on the right belt portion fit into corresponding female quick release 17L fitting on the left belt portion to releasably secure the belt around the patient's chest. The belt length on the left and right sides of the belt may be adjusted so that the buckles fall just over the center of the patient's chest during operation, or they may be adjusted for placement of the buckles elsewhere around the chest. The handle 18 is provided for convenient handling and carrying of the device.

Figure 3:
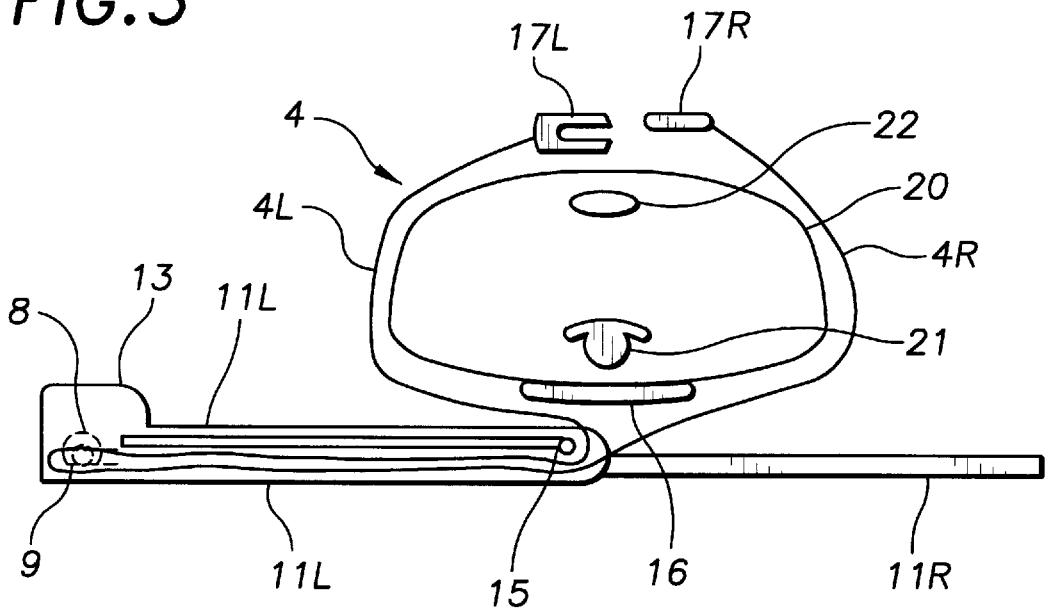
FIG. 3 illustrates the operation of the belt cartridge.

FIG. 3 shows a cross section of the belt cartridge. The housing 13 is relatively flat, (but may be wedge shaped to assist in sliding it under a patient) when viewed from the superior position. The left panel 11L sits atop the housing 13 and the right panel extends from the housing. In the unfolded position, the cartridge is flat enough to be slipped under a patient from the side. In the cross section view, the guide spindle 15 can be seen, and the manner in which the belt is threaded through the slot 9 of the drive spool 8 appears more clearly. The belt 4 comprises a single long band of tough fabric threaded through the drive spool slot 9 and extending from the drive spool to the right side quick releases 17R and also from the drive spool, over and around the guide spindle, and back toward the drive spool to the left side quick releases 17L. The belt is threaded through the drive spool 8 at its mid-portion, and around the guide spindle, where the left belt portion 4L folds around the guide spindle, under the friction liner and back to the left side of the cartridge, and the right belt portion 4R passes the spindle to reach around the patient's right side. The friction belt liner 16 is suspended above the guide spindle and belt, being mounted on the housing, and fits between the patient and the compression belt. The cartridge is placed under the patient 20, so that the guide spindle is located close to the spine 21 and substantially parallel to the spine, and the quick release fittings may be fastened over the chest in the general area of the sternum 22.

Figure 4:
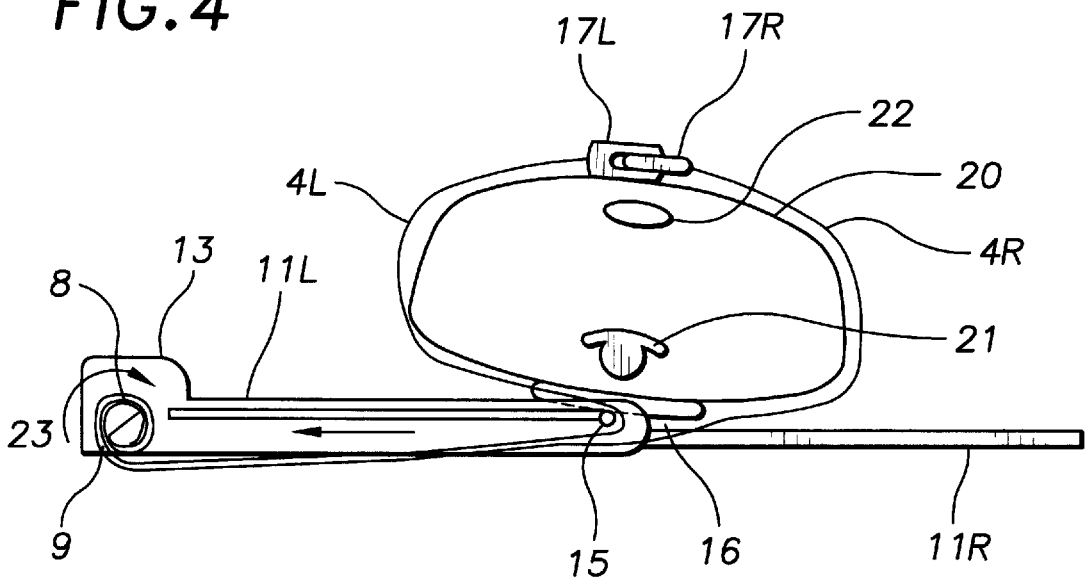
FIG. 4 illustrates the operation of the belt cartridge.

In use, the cartridge is slipped under the patient 20 and the left and right quick releases are connected. As shown in FIG. 4, when the drive spool is rotated, it takes up the middle portion of the belt and tightens the belt around the chest. The drive spool is unobstructed in its rotation, and is operable to rotate in excess of 360° during each compression. The spool may make several rotations, and spool several layers of compression belt, to pull the belt tight for a single compression. This enables several operating advantages, including the ability to take up slack of any length prior to compressing operation and the ability to closely control belt tension in response to feedback. Gear reduction is provided to reduce motor output of about 20,000 rpm to 40,000 rpm to spool output of about 180–240 rpm (from about 80 to 1 gearing ratio to 150 to 1 gearing ratio). (In recent embodiments, we have used spool output of 500–1000 rpm, with a gear ratio of 40-1, and these have performed well.) The gear reduction ratio depends on the motor rpm and the drive spool diameter, and the dual or single nature of the connection of the belt to the spool. Gear reduction allows lower power consumption and higher torque to be obtained from the motor, and permits a 250 msec rise time (the time it takes to pull the belt the desired length to generate the optimum peak pressure on the body of up to 6 psi.) Gear reduction allows lower power consumption and higher torque to be obtained from the motor, allows for optimum number of windings in the motor, resulting in higher torque for a given amperage, and allows application of existing electric motor (power tool) technology to reduce system cost. The compression force exerted by the belt is more than sufficient to induce or increase intrathoracic pressure necessary for CPR. When the belt is spooled around the drive spool 8, the chest of the patient is compressed significantly, as illustrated.

Figure 5:
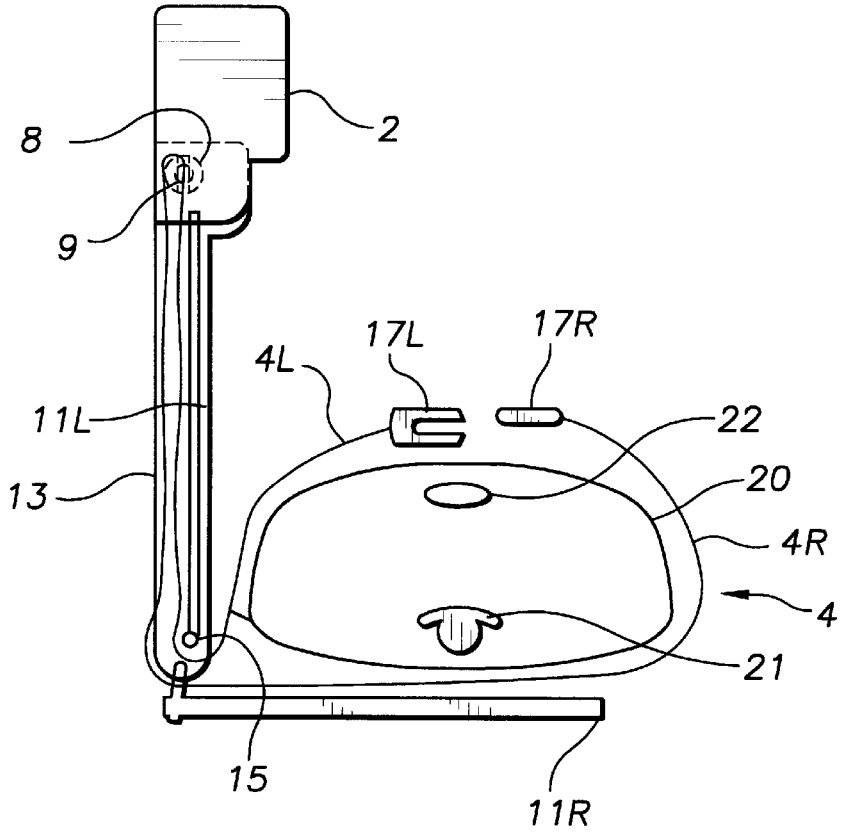
FIG. 5 illustrates an alternative configuration of the belt cartridge.
Figure 6:
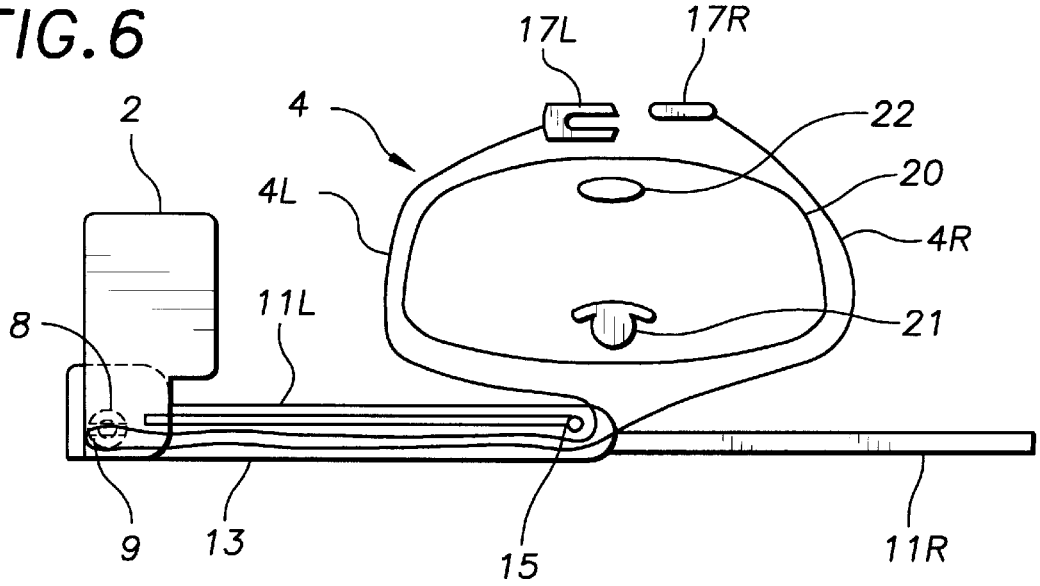
FIG. 6 illustrates an alternative configuration of the belt cartridge.

While it will usually be preferred to slide the cartridge under the patient, this is not necessary. The device may be fitted onto the patient with the buckles at the back or side, or with the motor to the side or above the patient, whenever space restrictions require it. As shown in FIG. 5, the cartridge may be fitted onto a patient 20 with only the right belt portion 4R and right panel 11R slipped under the patient, and with the right panel and left panel partially unfolded. The placement of the hinge between the right side and left side panels permits flexibility in installation of the device. FIG. 6 shows that the cartridge may also be fitted onto a patient 20 with both the right panel 11R and the left panel 11L slipped under the patient, but with the motor box 2 folded upward, rotated about the axis of the drive spool 8. These configurations are permitted by the modular nature of the motor box connection to the belt cartridge, and will prove useful in close spaces such as ambulances and helicopters. (Note that, though the belt may be tightened by spooling operation in either direction, tightening in the direction of arrow 23, clockwise when viewed from the top of the patient and the device, will cause reactive force which urges the motor box to rotate into the device, toward the body, rather than outwardly away from the body. Locking pins may be provided to prevent any rotational movement between the motor box and the cartridge. In the construction of the motor box as shown, the limited height of the box (the height of the box is less than the distance between the left flank of the patient and the drive spool) prevents contact with the patient in case the locking pins are not engaged for any reason. The rotation of the drive belt may be reversed to a counter clockwise direction, in which reactive force will urge the motor box to rotate outwardly. In this case, locking mechanisms such as locking pins can be used to protect operators from movement of the system.)

Regardless of the orientation of the panels, the reversing spindle will properly orient the travel of the belt to ensure compression. The placement of the spindle at the point where the right belt portion and the left belt portion diverge under the patient's chest, and the placement of this spindle in close proximity to the body, permits the belt to make contact with the chest at substantially all points on the circumference of the chest. The position of the spindle reverses the travel of the belt left portion 41 from a transverse right to left direction to a transverse left to right direction, while the fact that belt right portion 4R bypasses the spindle means that it always moves from right to left in relation to the patient when pulled by the drive spool. Thus the portions of the belt engaging the chest always pull from opposite lateral areas of the chest to a common point near a central point. In FIGS. 3 and 4, the opposite lateral areas correspond to the anatomic lateral area of the patient, and the central point corresponds to the spine. In FIG. 5, the lateral areas correspond to the spine and anterior left side of the torso, while the central point corresponds to the left lateral area of the chest. Additionally, the use of the single spindle at the center of the body, with the drive spool placed at the side of the body, permits simple construction and the detachable or modular embodiment of the motor assembly, and allows placement of the belt about the patient before attachment of the motor box to the entire device.

Figure 7:
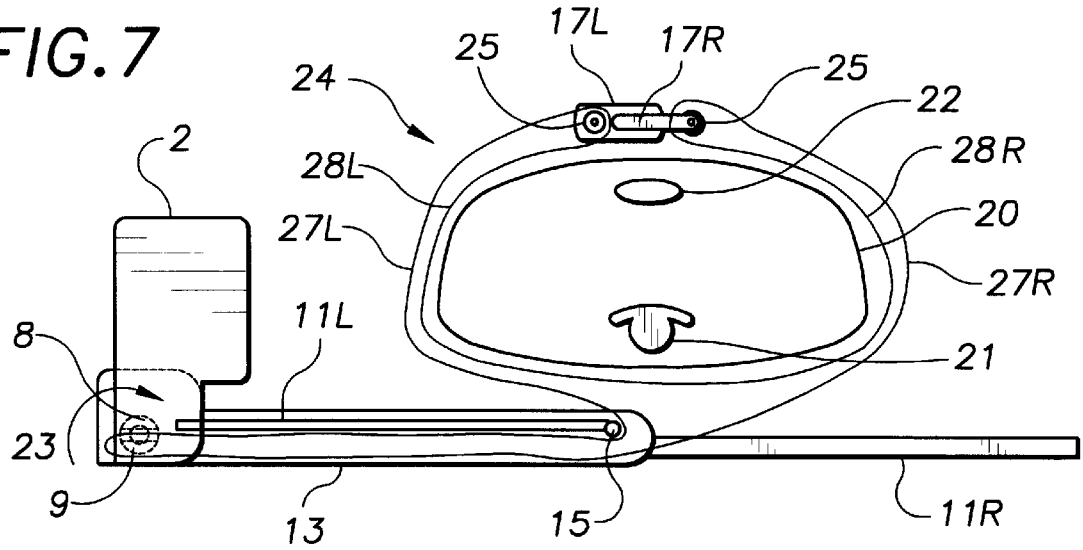
FIG. 7 illustrates an alternative configuration of the belt cartridge.

FIG. 7 illustrates an embodiment of the compression belt which reduces the take up speed for a given motor speed or gearing and allows for twice the compressive force for a given motorspeed (so, for a given number of revolutions of the drive spool, the change in belt length, or the rate of belt take up, is halved reducing the load on each section of the belt exerts). The compression belt comprises a loop 24 of belt material. The loop is threaded through the complex path around spindles 25 in the quick release fasteners 26, around the body to the guide spindle 15, around or past the guide spindle and into the drive spool 8. The left belt portion outer layer 27L and right belt portion outer layer 27R form, together with the left belt portion inner layer 28L and right belt portion inner layer 28R form a continues loop running inwardly from the fastener spindle, inwardly around the chest to the opposite drive spindle, outwardly from the opposite drive spindle, downwardly over the chest, past the guide spindle to the drive spool, through the drive spool slot and back under the guide spindle, reversing around the guide spindle and upwardly over the chest back to the fastener spindle. Thus both the inner and outer layers of this two layer belt are pulled toward the drive spool to exert compressive force on the body. This can provide for a decrease in friction as the belts will act on each other rather than directly on the patient. It will also allow for a lower torque, higher speed motor to exert the necessary force.

Figure 8:
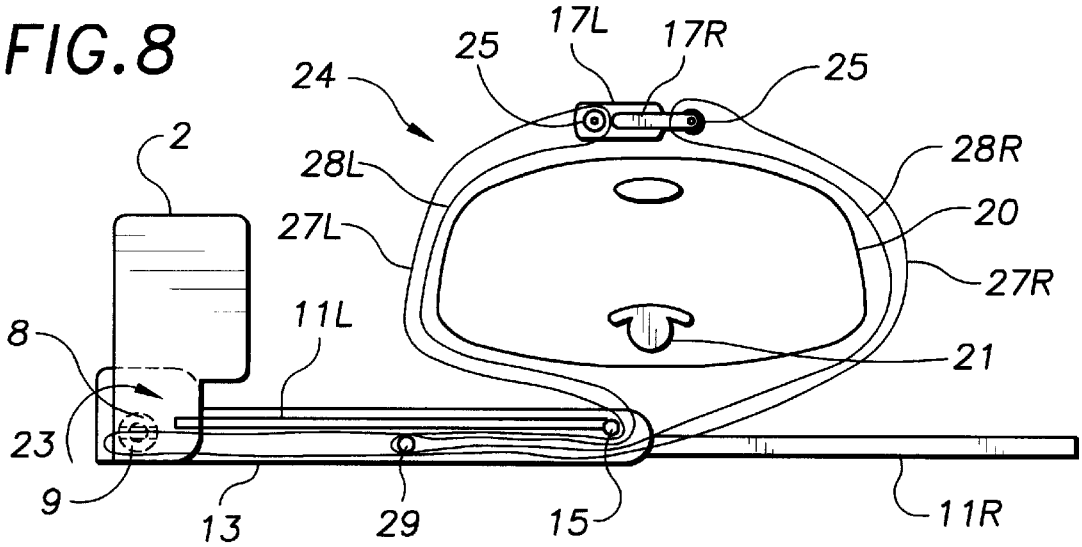
FIG. 8 illustrates an alternative configuration of the belt cartridge.

In FIG. 8, the double layer belt system is modified with structure which locks the inner belt portion in place, and prevents it from moving along the body surface. This has the advantage that the major portion of the belt in contact with the body does not slide relative to the body. To lock the belt inner layer in place relative to the loop pathway, the locking bar 29 is fixed within the housing 13 in parallel with the guide spindle 15 and the drive spool 8. The inner loop may be secured and fastened to the locking bar, or it may be slidably looped over the locking bar (and the locking bar may be rotatable, as a spindle). The left belt portion outer layer 27L and right belt portion outer layer 27R are threaded through the drive spool 8. With the locking bar installed, the rotation of the drive spool takes up the outer layer of the belt, and these outer layers are forced to slide over the left belt portion inner layer 28L and right belt portion inner layer 28R, but the inner layers do not slide relative to the surface of the patient (except, possibly, during a brief few cycles in which the belt centers itself around the patient, which will occur spontaneously due to the forces applied to the belt.

Figure 9:
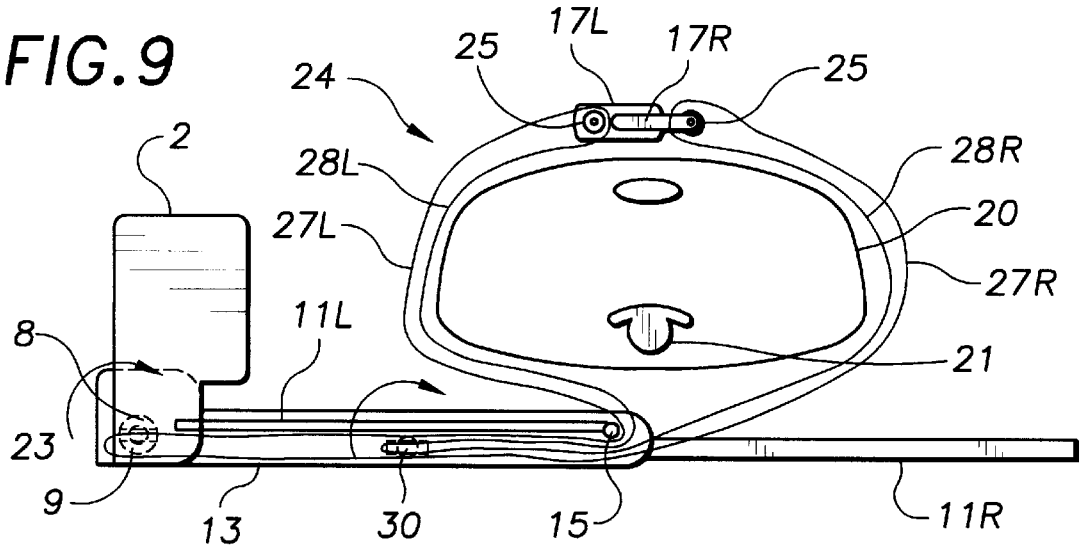
FIG. 9 illustrates an alternative configuration of the belt cartridge.

In FIG. 9, the double layer belt system is modified with structure which does not lock the inner belt portion in place or prevent it from moving along the body surface, but instead provides a second drive spool to act on the inner layer of the belt. To drive the belt inner layer relative to the loop pathway, the secondary drive spool 30 is fixed within the housing 13 in parallel with the guide spindle 15 and the drive spool 8. This secondary drive spool is driven by the motor, either through transmission geared within the housing or through a second receiving rod protruding from the housing and a secondary drive socket driven through appropriate gearing in the motor box. The inner loop may be secured and fastened to the secondary drive spool, or it may be threaded through the secondary drive spool slot 31. The left belt portion outer layer 27L and right belt portion outer layer 27R are threaded through the first drive spool 8. With the secondary drive spool, the rotation of the first drive spool 8 takes up the outer layer of the belt, and these outer layers are forced to slide over the left belt portion inner layer 28L and right belt portion inner layer 28R, while the secondary drive spool takes up the inner layers.

Figure 10:
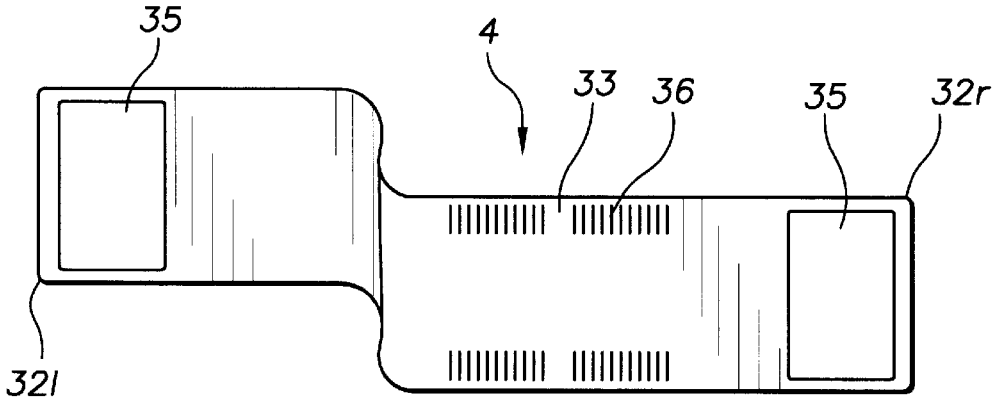
FIG. 10 illustrates an alternative embodiment of the belt.
Figure 11:
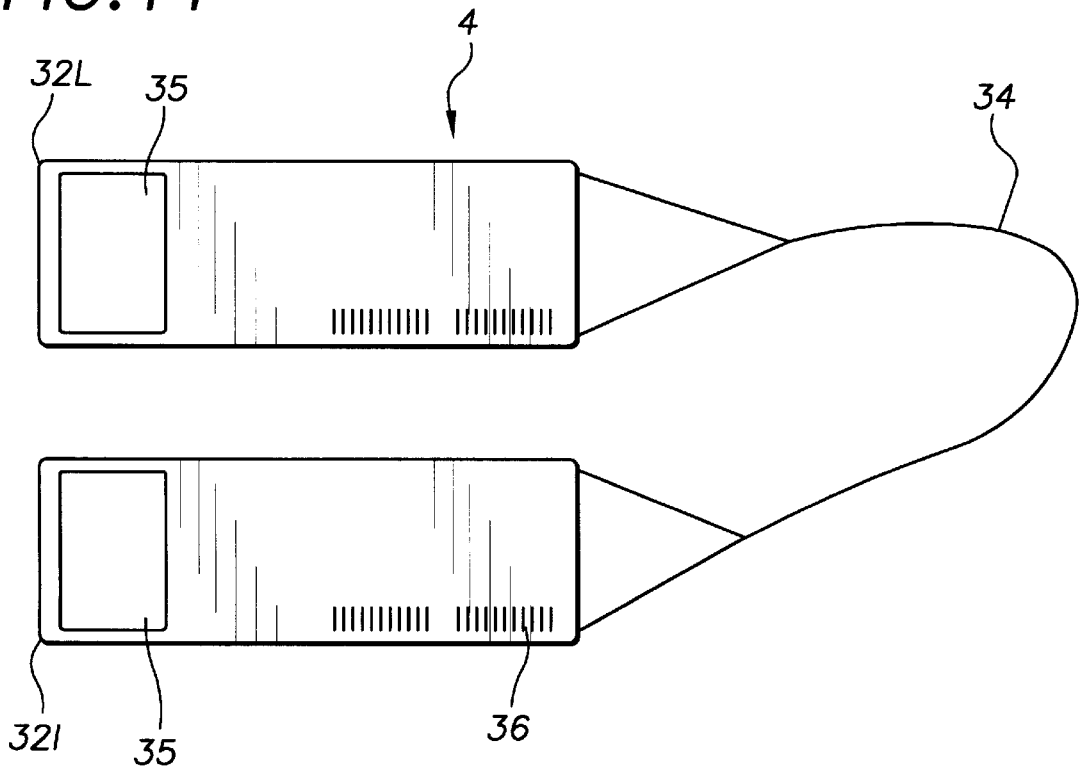
FIG. 11 illustrates an alternative embodiment of the belt.

The compression belt may be provided in several forms. It is preferably made of some tough material such as parachute cloth or tyvek. In the most basic form shown in FIG. 10, the belt 4 is a plain band of material with fastening ends 32*l* and 32*r*, corresponding left and right belt portions 4L and 4R, and the spool engaging center portion 33. While we have used the spool slot in combination with the belt being threaded through the spool slot as a convenient mechanism to engage the belt in the drive spool, the belt may be fixed to the drive spool in any manner. In FIG. 11, the compression belt is provided in two distinct pieces comprising left and right belt portions 4L and 41R connected with a cable 34 which is threaded through the drive spool. This construction permits a much shorter drive spool, and may eliminate friction within the housing inherent in the full width compression band of FIG. 10. The fastening ends 32L and 32R are fitted with hook and loop fastening elements 35 which may be used as an alternative to other quick release mechanisms. To provide a measurement of belt pay-out and take-up during operation, the belt or cable may be modified with the addition of a linear encoder scale, such as scale 36 on the belt near the spool engaging center portion 33. A corresponding scanner or reader may be installed on the motor box, or in the cartridge in apposition to the encoder scale.

Figure 12:
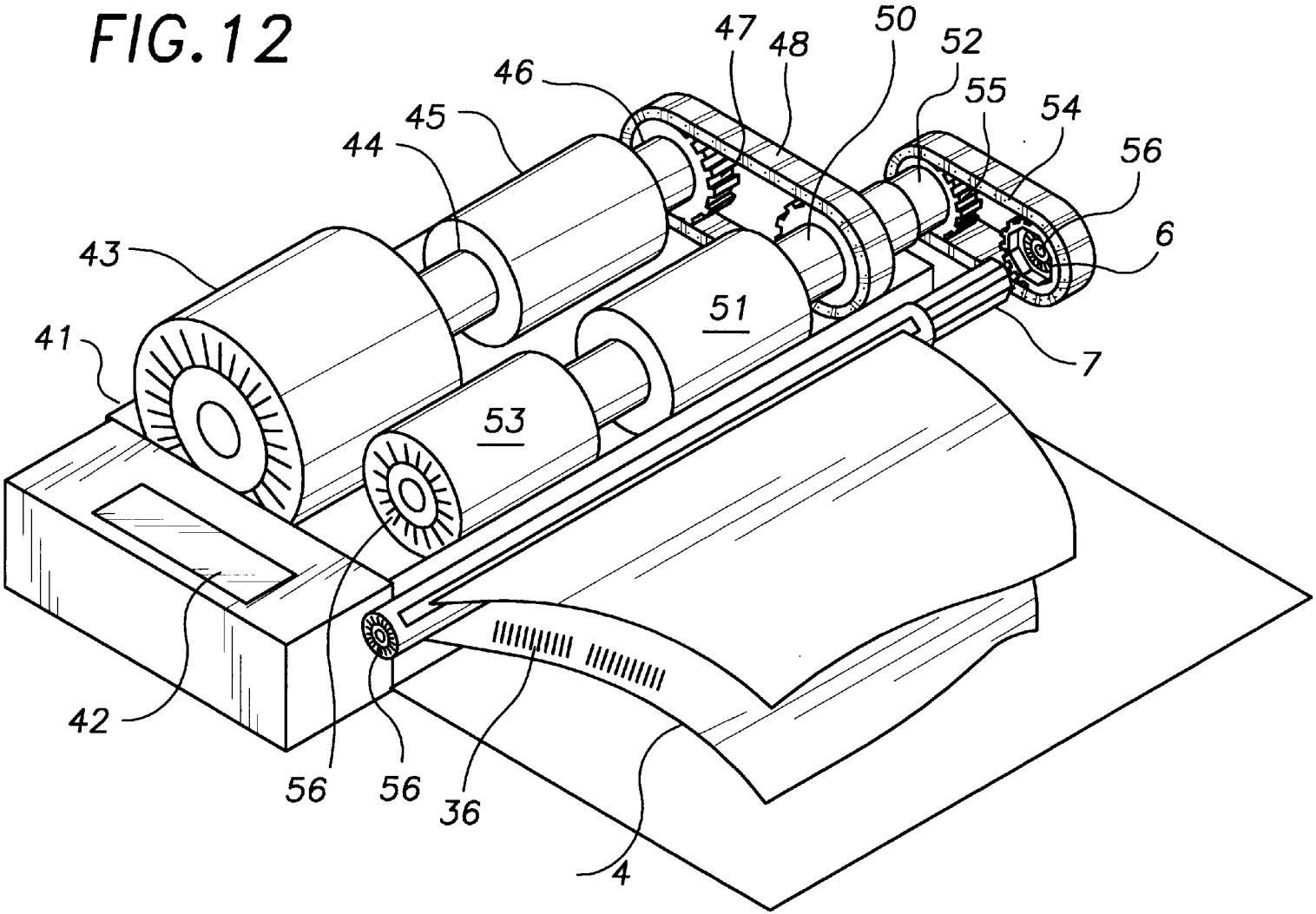
FIG. 12 illustrates the configuration of the motor and clutch within the motor box.

FIG. 12 illustrates the configuration of the motor and clutch within the motor box. The exterior of the motor box includes a housing 41, and a computer module 10 with a convenient display screen 42 for display of any parameters measured by the system. The motor 43 is a typical small battery operated motor which can exert the required belt tensioning torque. The motor shaft 44 is lined up directly to the brake 45 which includes reducing gears and a cam brake to control free spinning of the motor when the motor is not energized (or when a reverse load is applied to the gearbox output shaft). The gearbox output rotor 46 connects to a wheel 47 and chain 48 which connect to the input wheel 49, and thereby to the transmission rotor 50 of the clutch 51. The clutch 51 controls whether the input wheel 49 engages the output wheel 52, and whether rotary input to the input wheel is transmitted to the output wheel. (The secondary brake 53, which we refer to as the spindle brake, provides for control of the system in some embodiments, as explained below in reference to FIG. 17.) The output wheel 52 is connected to the drive spool 8 via the chain 54 and drive wheel 6 and receiving rod 7 (the drive rod is on the cartridge). The drive wheel 6 has receiving socket 5 which is sized and shaped to mate and engage with the drive rod 7 (simple hexagonal or octagonal socket which matches the drive rod is sufficient). While we use a wrap spring brake (a MAC 45 sold by Warner Electric) for the spindle brake in the system, any form of brake may be employed. The wrap spring brake has the advantage of allowing free rotating of the shaft when de-energized, and holds only when energized. The wrap spring brake may be operated independently of the motor. We use a drawn cup roller bearing as the cam brake, where the inner race (connected to the motor) rotates freely in one direction (the tightening direction) and the outer race prevents reverse direction travel (in the loosening direction). This arrangement acts as a brake when the motor is off and the clutch is on. While we use chains to transmit power through the system, belts, gears or other mechanisms may be employed.

Figures 12A, 12B:
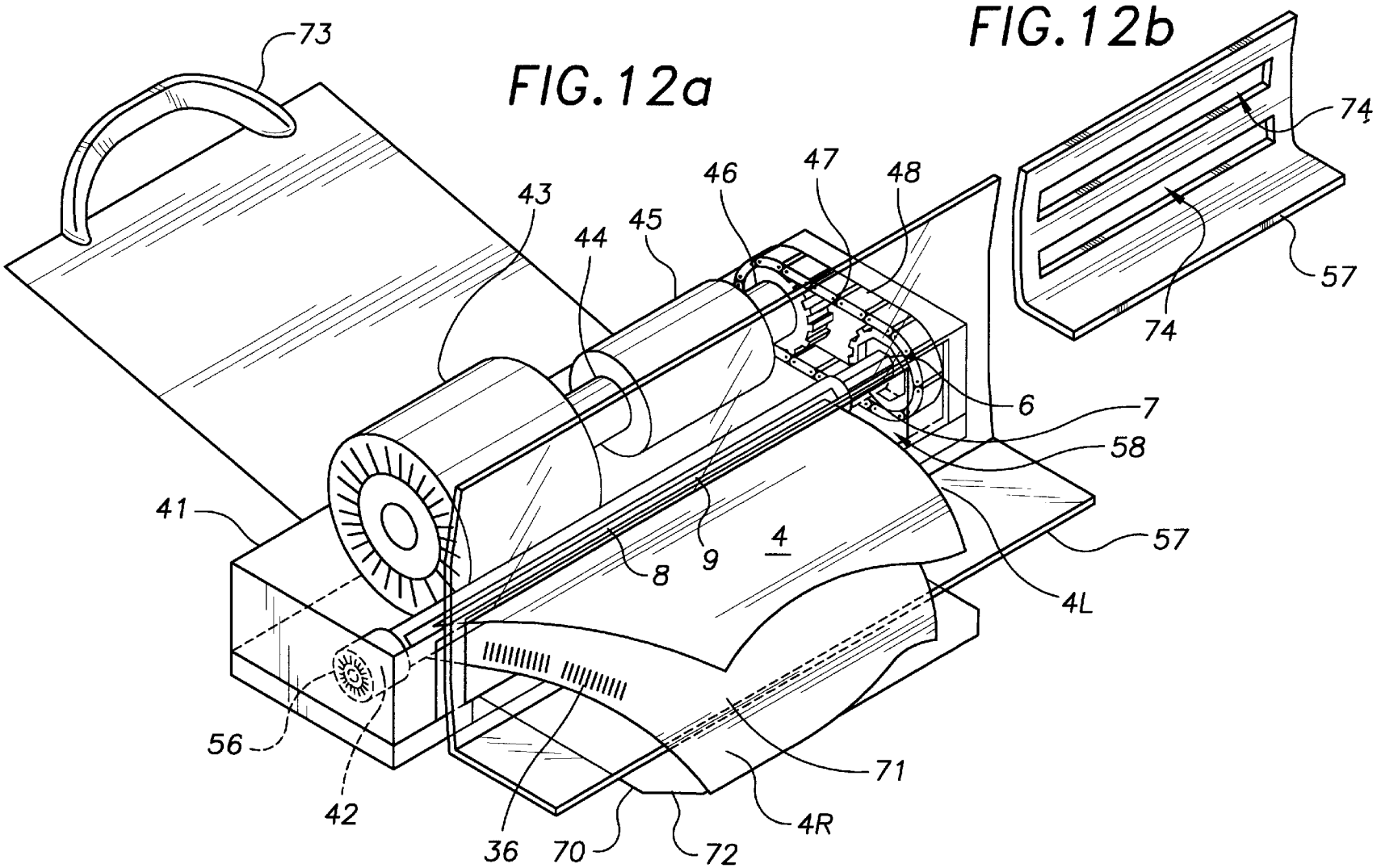
FIG. 12*a* illustrates the configuration of the motor and clutch within the motor box.

FIG. 12*a* illustrates the configuration of the motor and clutch within the motor box. The exterior of the motor box includes a housing 41 which holds the motor 43 is a typical small battery operated motor which can exert the required belt tensioning torque (for example, a Mabuchi Motors RS775VF-909 12V DC motor). The motor shaft 44 is lined up directly to the brake 45 which includes reducing gears and a cam. The gearbox output rotor 46 connects to brake to the output wheel 47 and chain 48 which in turn connects directly to the drive wheel 6 and receiving rod 7. The drive spool 8 is contained within the housing 41. At the end of the drive spool opposite the drive wheel, the brake 55 is directly connected to the drive spool. The belt 4 is threaded through the drive spool slot 9. To protect the belt from rubbing on the motor box, the shield 57 with the long aperture 58 is fastened to the housing so that the aperture lies over the drive spool, allowing the belt to pass through the aperture and into the drive spool slot, and return out of the housing. Under the housing, slidably disposed within a channel in the bottom of the housing, a push plate 70 is positioned so that it can slide back and forth relative to the housing. The belt right portion 4 is fitted with a pocket 71 which catches or mates with the right tip 72 of the push plate. The right tip of the push plate is sized and dimensioned to fit within the pocket. By means of this mating mechanism, the belt can be slipped onto the push plate, and with the handle 73 on the left end of the push plate, the push plate together with the right belt portion can be pushed under a patient. The belt includes the encoder scale 36, which can be read with an encoder scanner mounted on or within the housing. In use, the belt right portion is slipped under the patient by fastening it to the push plate and sliding the push plate under the patient. The motor box can then be positioned as desired around the patient (the belt will slip through the drive spool slot to allow adjustment). The belt right side can then be connected to the belt left portion so that the fastened belt surrounds the patient's chest. In both FIGS. 12 and 12*a*, the motor is mounted in side-by-side relationship with the clutch and with the drive spool. With the side-by-side arrangement of the motor and the roller, the motor may be located to the side of the patient, and need not be placed under the patient, or in interfering position with the shoulders or hips. This also allows a more compact storage arrangement of the device, vis-à-vis an in-line connection between the motor and the roller. A battery is placed within the box or attached to the box as space allows.

During operation, the action of the drive spool and belt draw the device toward the chest, until the shield is in contact with the chest (with the moving belt interposed between the shield and the chest). The shield also serves to protect the patient from any rough movement of the motor box, and help keep a minimum distance between the rotating drive spool and the patients skin, to avoid pinching the patient or the patient's clothing in the belt as the two sides of the belt are drawn into the housing. As illustrated in FIG. 12*b*, the shield 57 may also include two lengthwise apertures 74 separated by a short distance. With this embodiment of the shield, one side of the belt passes through one aperture and into the drive spool slot, and the other side of the belt exits from the drive spool slot and outwardly through the other aperture in the shield. The shield as shown has an arcuate transverse cross section (relative to the body on which it is installed). This arcuate shape permits the motor box to lay on the floor during use while a sufficient width of shield extends between the box and the belt. The shield made of plastic, polyethylene, PTFE, or other tough material which allows the belt to slide easily. The motor box, may, however, be placed anywhere around the chest of the patient.

A computer module which acts as the system controller is placed within the box or attached to the box and is operably connected to the motor, the cam brake, clutch, encoder and other operating parts, as well as biological and physical parameter sensors included in the overall system (blood pressure, blood oxygen, end tidal CO2, body weight, chest circumference, etc. are parameters that can be measured by the system and incorporated into the control system for adjusting compression rates and torque thresholds, or belt pay-out and slack limits). The computer module can also be programmed to handle various ancillary tasks such as display and remote communications, sensor monitoring and feedback monitoring, as illustrated in our prior application 08/922,723.

The computer is programmed (with software or firmware or otherwise) and operated to repeatedly turn the motor and release the clutch to roll the compression belt onto the drive spool (thereby compressing the chest of the patient) and release the drive spool to allow the belt to unroll (thereby allowing the belt and the chest of the patient to expand), and hold the drive spool in a locked or braked condition during periods of each cycle. The computer is programmed to monitor input from various sensors, such as the torque sensor or belt encoders, and adjust operation of the system in response to these sensed parameters by, for example, halting a compression stroke or slipping the clutch (or brake) in response to torque limit or belt travel limits. As indicated below, the operation of the motor box components may be coordinated to provide for a squeeze and hold compression method which prolongs periods of high intrathoracic pressure. The system may be operated in a squeeze and quick release method for more rapid compression cycles and better waveform and flow characteristics in certain situations. The operation of the motor box components may be coordinated to provide for a limited relaxation and compression, to avoid wasting time and battery power to move the belt past compression threshold limits or slack limits. The computer is preferably programmed to monitor two or more sensed parameters to determine an upper threshold for belt compression. By monitoring motor torque as measured by a torque sensor, current sensor or a rotational torque sensor, and paid out belt length as determined by a belt encoder, shaft encoder or motor encoder, the system can limit the belt take-up with redundant limiting parameters. The redundancy provided by applying two limiting parameters to the system avoids over-compression in the case that a single compression parameter exceed the safe threshold while the system fails to sense and response the threshold by stopping belt take-up.

An angular optical encoder may be placed on any rotating part of the system to provide feedback to a motor controller relating to the condition of the compression belt. (The encoder system may be an optical scale coupled to an optical scanner, a magnetic or inductive scale coupled to a magnetic or inductive encoder, a rotating potentiometer, or any one of the several encoder systems available.) The encoder 56, for example, is mounted on the secondary brake 53 (in FIG. 12), and provides an indication of the motor shaft motion to a system controller. An encoder may also be placed on the drive socket 5 or drive wheel 6, the motor 43 and or motor shaft 44. The system includes a torque sensor (sensing current supply to the motor, for example), and monitors the torque or load on the motor. For either or both parameters, a threshold is established above which further compression is not desired or useful, and if this occurs during the compression of the chest, then the clutch is disengaged. The belt encoder is used by the control system to track the take-up of the belt, and to limit the length of belt which is spooled upon the drive belt.

In order to control the amount of thoracic compression (change in circumference) for the cardiac compression device using the encoder, the control system must establish a baseline or zero point for belt take-up. When the belt is tight to the point where any slack has been taken up, the motor will require more current to continue to turn under the load of compressing the chest. This the expected rapid increase in motor current draw (motor threshold current draw) is measured through torque sensor (an Amp meter, a voltage divider circuit, a measured drop across a small precision resistor, or the like). This spike in current or voltage is taken as the signal that the belt has been drawn tightly upon the patient and the paid out belt length is an appropriate starting point, and the encoder measurement at this point is zeroed within the system (that is, taken as the starting point for belt take-up). Another mechanism for determining the starting point for belt operation is the rate of change of the encoder position. The system is set up to monitor the encoder position. During the period in which the drive spool is operating to take up slack in the compression belt, the encoders will be moving rapidly. As soon as all slack is taken up, belt travel speed, and hence encoder rate of change, will slow considerably. The system may also be programmed to detect this rate of change of encoder position, and to interpret it as the slack take-up/pretightened point. Thus, the pre-tightening of the belt may be sensed with a number of methods. The encoder then provides information used by the system to determine the change in length of the belt from this pre-tightened position. The ability to monitor and control the change in length allows the controller to control the amount of pressure exerted on the patient and the change in volume of the patient by limiting the length of belt take-up during a compression cycle. Note that the spool, when constructed as shown, has a small diameter relative to the total belt travel, and this requires several rotations of the spool for each compression cycle. Multiple drive spool rotations allow for finer control based on encoder feedback because the encoder rotates or travels farther vis-à-vis a partial rotation of a single large spool.

The expected length of belt take-up for optimum compression is 1 to 6 inches. However, six inches of travel on a thin individual may create a excessive change in thoracic circumference and present the risk of injury from the device. In order to overcome this problem, the system determines the necessary change in belt length required by measuring the amount of belt travel required to become taught as described above. Knowing the initial length of the belt and subtracting off the amount required to become taught will provide a measure of the patient's size (chest circumference). The system then relies on predetermined limits or thresholds to the allowable change in circumference for each patient on which it is installed, which can be used to limit the change in volume and pressure applied to the patient. The threshold may change with the initial circumference of the patient so that a smaller patient will receive less of a change in circumference as compared to a larger patient. The encoder provides constant feedback as to the state of travel and thus the circumference of the patient at any given time. When the belt take-up reaches the threshold (change in volume), the system controller ends the compression stroke and continues into the next period of hold or release as required by the compression/decompression regimen programmed into the controller. The encoder also enables the system to limit the release of the belt so that it does not fully release. This release point can be determined by the zero point established on the pre-tightening first take-up, or by taking a percentage of the initial circumference or a sliding scale triggered by the initial circumference of the patient.

The belt could also be buckled so that it remains tight against the patient. Requiring the operator to tighten the belt provides for a method to determine the initial circumference of the patient. Again encoders can determine the amount of belt travel and thus can be used to monitor and limit the amount of change in the circumference of the patient given the initial circumference.

Figures 13, 13A:
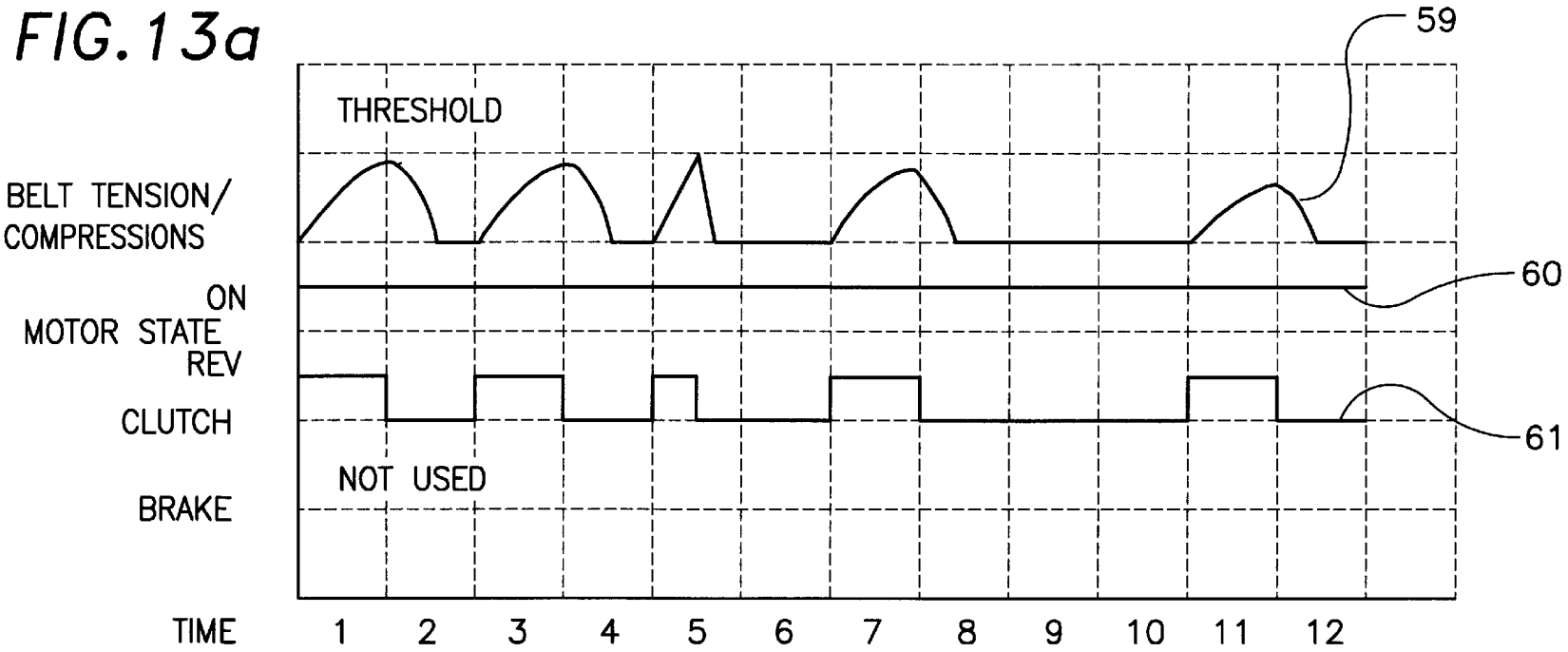
FIG. 13 is a table of the motor and clutch timing in a basic embodiment.
FIG. 13*a* is a diagram of the pressure changes developed by the system operated according to the timing diagram of FIG. 13.

Several compression and release patterns may be employed to boost the effectiveness of the CPR compression. Typical CPR compression is accomplished at 60–80 cycles per minute, with the cycles constituting mere compression followed by complete release of compressive force. This is the case for manual CPR as well as for known mechanical and pneumatic chest compression devices. With our new system, compression cycles in the range of 20–70 cpm have been effective, and the system may be operated as high as 120 cpm or more. This type of compression cycle can be accomplished with the motor box with motor and clutch operation as indicated in FIG. 13. When the system is operating in accordance with the timing table of FIG. 13, the motor is always on, and the clutch cycles between engagement (on) and release (off). After several compressions at time periods T1, T3, T5 and T7, the system pauses for several time periods to allow a brief period (several seconds) to provide a respiration pause, during which operators may provide ventilation or artificial respiration to the patient, or otherwise cause oxygenated air to flow into the patient's lungs. (The brakes illustrated in FIG. 12, are not used in this embodiment, though they may be installed.) The length of the clutch engagement period is controlled in the range of 0–2000 msec, and the time between periods of clutch engagement is controlled in the range of 0–2000 msec (which of course is dictated by medical considerations and may change as more is learned about the optimal rate of compression).

The timing chart of FIG. 13*a* illustrates the intra-thoracic pressure changes caused by the compression belt when operated according to the timing diagram of FIG. 13. The chest compression is indicated by the status line 59. The motor is always on, as indicated by motor status line 60. The clutch is engaged or "on" according to the square wave clutch status line 61 in the lower portion of the diagram. Each time the clutch engages, the belt is tightened around the patient's chest, resulting in a high pressure spike in belt tension and intrathoracic pressure as indicated by the compression status line 59. Pulses p1, p2, p3, p4 and p5 are all similar in amplitude and duration, with the exception of pulse p3. Pulse p3 is limited in duration in this example to show how the torque limit feedback operates to prevent excessive belt compression. (Torque limit may be replaced by belt travel or other parameter as the limiting parameter.) As an example of system response to sensing the torque limit, pulse p3 is shown rapidly reaching the torque limit set on the motor. When the torque limit is reached, the clutch disengages to prevent injury to the patient and excessive drain on the battery (excessive compression is unlikely to lead to additional blood flow, but will certainly drain the batteries quickly). Note that after clutch disengagement under pulse p3, belt tension and intra-thoracic pressure drop quickly, and the intra-thoracic pressure is increased for only a small portion of cycle. After clutch disengagement based on an over-torque condition, the system returns to the pattern of repeated compressions. Pulse p4 occurs at the next scheduled compression period T7, after which the respiration pause period spanning T8, T9, and T10 is created by maintaining the clutch in the disengaged condition. After the respiration pause, pulse p5 represents the start of the next set of compressions. The system repeatedly performs sets of compressions followed by respiration pauses until interrupted by the operator.

Regarding the leading edge of each compression, it is advantageous to cause the compression to take place very quickly. The ramp-up from the no-slack position of the belt to the peak compression of the belt is ideally performed in a time period less than 300 msec, and preferably faster than 150 msec. This fast ramp up can be accomplished by operating the motor and clutch as described below.

Figures 14, 14A:
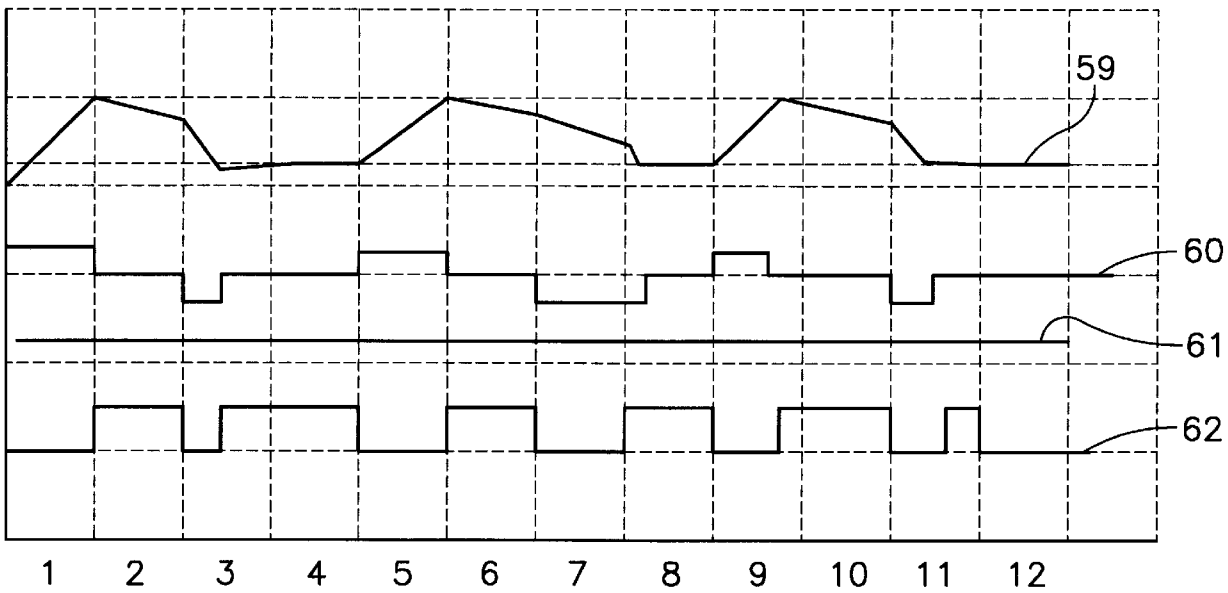
FIG. 14 is a table of the motor and clutch timing in a basic embodiment.
FIG. 14*a* is a diagram of the pressure changes developed by the system operated according to the timing diagram of FIG. 14.

FIG. 14 illustrates the timing of the motor, clutch and cam brake in a system that allows the belt compression to be reversed by reversing the motor. It also provides for compression hold periods to enhance the hemodynamic effect of the compression periods, and relaxation holds to limit the belt pay-out in the relaxation period to the point where the belt is still taut on the chest and not excessively loose. As the diagram indicates, the motor operates first in the forward direction to tighten the compression belt, then is turned off for a brief period, then operates in the reverse direction and turns off, and continues to operate through cycles of forward, off, reverse, off, and so on. In parallel with these cycles of the motor state, the cam brake is operating to lock the motor drive shaft in place, thereby locking the drive roller in place and preventing movement of the compression belt. Brake status line 62 indicates the status of the brake 45. Thus, when the motor tightens the compression belt up to the threshold or time limit, the motor turns off and the cam brake engages to prevent the compression belt form loosening. This effectively prevents relaxation of the patient's chest, maintaining a higher intra-thoracic pressure during hold periods T2, T6 and T10. Before the next compression cycle begins, the motor is reversed and the cam brake is disengaged, allowing the system to drive the belt to a looser length and allowing the patient's chest to relax. Upon relaxation to the lower threshold corresponding to the pre-tightened belt length, the cam brake is energized (that is, activated) to stop the spindle and hold the belt at the pre-tightened length. The clutch is engaged at all times (the clutch may be omitted altogether if no other compression regimen is desired in the system). (This embodiment may incorporate two motors operating in different directions, connecting to the spindle through clutches, or a reversing clutch mechanism.)

FIG. 14*a* illustrates the intra-thoracic pressure changes caused by the compression belt when operated according to the timing diagram of FIG. 14*a*. The clutch, if any, is always on as indicated by clutch status line 61. The cam brake is engaged or "on" according to the square wave in the lower portion of the diagram. The motor is on, off, or reversed according to motor state line. Each time the motor is turned on in the forward direction, the belt is tightened around the patient's chest, resulting in a high pressure spike in belt tension and intrathoracic pressure as shown in the pressure plot line. Each time the high threshold limit is sensed by the system and the motor is de-energized, the cam brake engages to prevent further belt movement. This results in a high maintained pressure or "hold pressure" during the hold periods indicated on the diagram (time period T2, for example). At the end of the hold period, the motor is reversed to drive the belt to a relaxed position, then de-energized. When the motor is turned off after a period of reverse operation, the cam brake engages to prevent excess slacking of the compression belt (this would waste time and battery power). The cam brake disengages when the cycle is reinitiated and the motor is energized to start another compression. Pulses p1, p2, are similar in amplitude and duration. Pulse p3 is limited in duration in this example to show how the torque limit feedback operates to prevent excessive belt compression. Pulse p3 rapidly reaches the torque limit set on the motor (or the take-up limit set on the belt), and the motor stops and the cam brake engages to prevent injury to the patient and excessive drain on the battery. Note that after motor stop and cam brake engagement under pulse p3, belt tension and intra-thoracic pressure are maintained for the same period as all other pulses, and the intra-thoracic pressure is decreased only slightly, if at all, during the high pressure hold period. After pulse, p3, a respiration pause may be initiated in which the belt tension is permitted to go completely slack.

Figures 15, 15A:
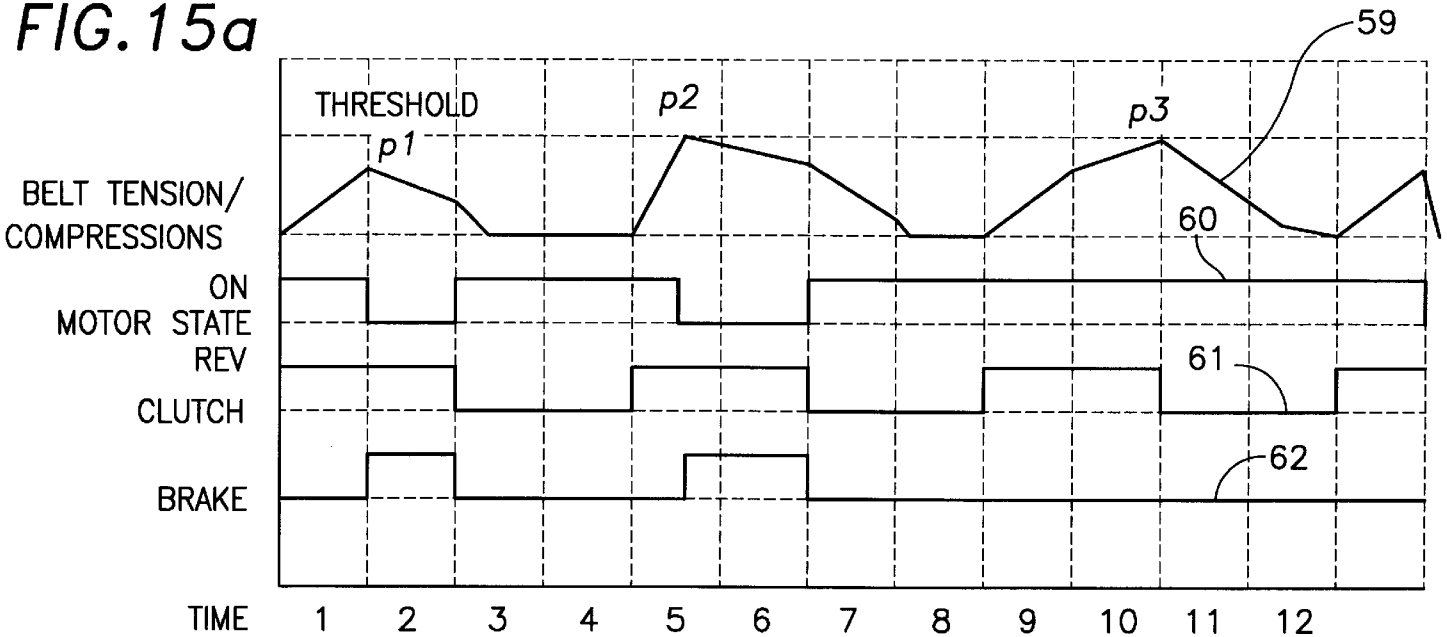
FIG. 15 is a table of the motor and clutch timing for squeeze and hold operation of the compression belt.
FIG. 15*a* is a diagram of the pressure changes developed by the system operated according to the timing diagram of FIG. 15.

FIG. 15 illustrates the timing of the motor, clutch and cam brake in a system that allows the belt compression to completely relax during each cycle. As the table indicates, the motor operates only in the forward direction to tighten the compression belt, then is turned off for a brief period, and continues to operate through on and off cycles. In the first time period T1, the motor is on and the clutch is engaged, tightening the compression belt about the patient. In the next time period T2, the motor is turned off and the cam brake is energized (with the clutch still engaged) to lock the compression belt in the tightened position. In the next time period T3, the clutch is disengaged to allow the belt to relax and expand with the natural relaxation of the patient's chest. In the next period t4, the motor is energized to come up to speed, while the clutch is disengaged and the cam brake is off. The motor comes up to speed with no effect on the compression belt in this time period. In the next time period, the cycle repeats itself. Thus, when the motor tightens the compression belt up to the threshold or time limit, the motor turns off and the cam brake engages to prevent the compression belt from loosening. This effectively prevents relaxation of the patient's chest, maintaining a higher intra-thoracic pressure. Before the next compression cycle begins, the clutch is disengaged, allowing the chest to relax and allowing the motor to come up to speed before coming under load. This provides much more rapid belt compression, leading to a sharper increase in intra-thoracic pressure.

FIG. 15*a* illustrates the intra-thoracic pressure changes caused by the compression belt when operated according to the timing table of FIG. 15. The clutch is turned on only after the motor has come up to speed, according to the clutch status line 61 and motor status line 60, which shows that the motor is energized for two time periods before clutch engagement. The cam brake is engaged or "on" according to the brake status line 62 in the lower portion of the diagram. Each time the clutch is engaged, the belt is tightened around the patient's chest, resulting in a sharply increasing high pressure spike in belt tension and intra-thoracic pressure as shown in the pressure plot line. Each time the motor is de-energized, the cam brake engages and clutch remains engaged to prevent further belt movement, and the clutch prevents relaxation. This results in a high maintained pressure or "hold pressure" during the hold periods indicated on the diagram. At the end of the hold period, the clutch is de-energized to allow the belt to expand to the relaxed position. At the end of the cycle, the cam brake is disengaged (with the clutch disengaged) to allow the motor to come up to speed before initiation of the next compression cycle. The next cycle is initiated when the clutch is engaged. This action produces the sharper pressure increase at the beginning of each cycle, as indicated by the steep curve at the start of each of the pressure Pulses p1, p2, and p3. Again, these pressure pulses are all similar in amplitude and duration, with the exception of pulse p2. Pulse p2 is limited in duration in this example to show how the torque limit feedback operates to prevent excessive belt compression. Pulse p2 rapidly reaches the torque limit set on the motor, and the motor stops and the cam brake engages to prevent injury to the patient and excessive drain on the battery. Note that after motor stop and cam brake engagement under pulse p2, belt tension and intra-thoracic pressure are maintained for the same period as all other pulses, and the intra-thoracic pressure is decreased only slightly during the hold period. The operation of the system according to FIG. 15*a* is controlled to limit belt pressure to a threshold measured by high motor torque (or, correspondingly, belt strain or belt length, belt force, belt pressure, etc.).

Figures 16, 16A:
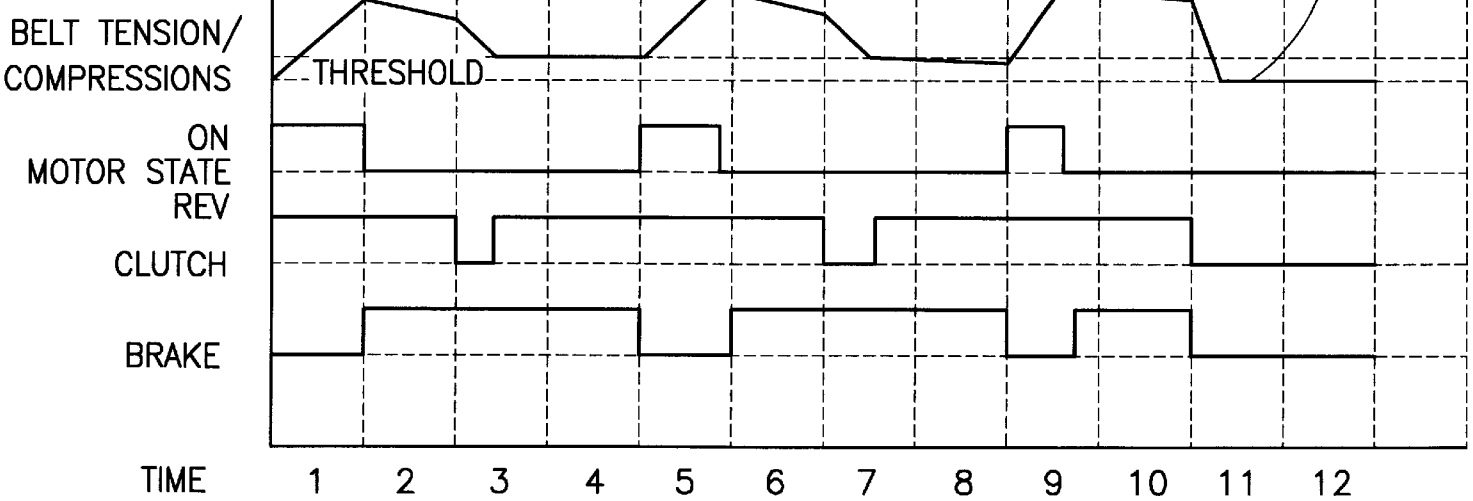
FIG. 16 is a table of the motor and clutch timing for squeeze and hold operation of the compression belt.
FIG. 16*a* is a diagram of the pressure changes developed by the system operated according to the timing diagram of FIG. 16.

FIG. 16 illustrates the timing of the motor, clutch and cam brake in a system that does not allow the belt compression to completely relax during each cycle. Instead, the system limits belt relaxation to a low threshold of motor torque, belt strain, or belt length. As the table indicates, the motor operates only in the forward direction to tighten the compression belt, then is turned off for a brief period, and continues to operate through on and off cycles. In the first time period T1, the motor is on and the clutch is engaged, tightening the compression belt about the patient. In the next time period T2, the motor is turned off and the cam brake is energized (with the clutch still engaged) to lock the compression belt in the tightened position. In the next time period T3, the clutch is disengaged to allow the belt to relax and expand with the natural relaxation of the patient's chest. The drive spool will rotate to pay out the length of belt necessary to accommodate relaxation of the patient's chest. In the next period t4, while the motor is still off, the clutch is engaged (with the cam brake still on) to prevent the belt from becoming completely slack. To start the next cycle at T5, the motor starts and the cam brake is turned off and another compression cycle begins.

FIG. 16*a* illustrates the intrathoracic pressure and belt strain that corresponds to the operation of the system according to FIG. 16. Motor status line 60 and the brake status line 62 indicate that when the motor tightens the compression belt up to the high torque threshold or time limit, the motor turns off and the cam brake engages to prevent the compression belt from loosening. Thus the high pressure attained during uptake of the belt is maintained during the hold period starting at T2. When the belt is loosened at T3 by release of the clutch (which uncouples the cam brake), the intrathoracic pressure drops as indicated by the pressure line. At T4, after the compression belt has loosened to some degree, but not become totally slack, the clutch engages (and recouples the cam brake) to hold the belt at some minimum level of belt pressure. This effectively prevents total relaxation of the patient's chest, maintaining a slightly elevated intra-thoracic pressure even between compression cycles. A period of low level compression is created within the cycle. Note that after several cycles (four or five cycles) a respiration pause is incorporated into the compression pattern, during which the clutch is off, the cam brake is off to allow for complete relaxation of the belt and the patient's chest. (The system may be operated with the low threshold in effect, and no upper threshold in effect, creating a single low threshold system.) The motor may be energized between compression period, as shown in time periods T11 and T12, to bring it up to speed before the start of the next compression cycle.

Figures 17, 17A:
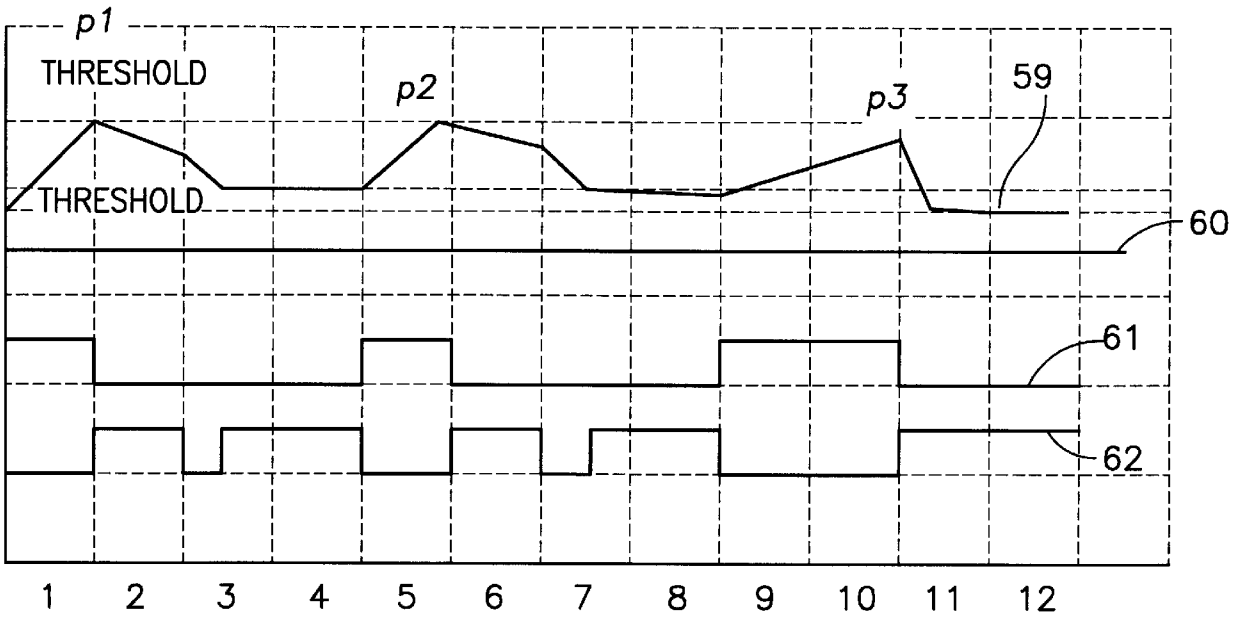
FIG. 17 is a table of the motor and clutch timing for squeeze and hold operation of the compression belt.
FIG. 17*a* is a diagram of the pressure changes developed by the system operated according to the timing diagram of FIG. 17.

FIG. 17 shows a timing table for use in combination with a system that uses the motor, clutch, and secondary brake 53 or a brake on the drive wheel or the spindle itself. The brake 45 is not used in this embodiment of the system (though it may be installed in the motor box). As the table indicates, the motor operates only in the forward direction to tighten the compression belt, and is always on. In the first time period T1, the motor is on and the clutch is engaged, tightening the compression belt about the patient. In the next time period T2, the motor is on but the clutch is disengaged and the brake 53 is energized to lock the compression belt in the tightened position. In the next time period T3, the clutch is disengaged and the brake is off to allow the belt to relax and expand with the natural relaxation of the patient's chest. The drive spool will rotate to pay out the length of belt necessary to accommodate relaxation of the patient's chest. In the next period t4, while the motor is still on, the clutch is disengaged, but energizing the spindle brake is effective to lock the belt prevent the belt from becoming completely slack (in contrast to the systems described above, the operation of the spindle brake is effective when the clutch is disengaged because the spindle brake is downstream of the clutch). To start the next cycle at T5, the motor starts and the spindle brake is turned off, the clutch is engaged and another compression cycle begins. During pulse p3, the clutch is engaged for time periods T9 and T10 while the torque threshold limit is not achieved by the system. This provides an overshoot compression period, which can be interposed amongst the torque limited compression periods.

FIG. 17*a* illustrates the intrathoracic pressure and belt strain that corresponds to the operation of the system according to FIG. 17. Motor status line 60 and the brake status line 62 indicate that when the motor tightens the compression belt up to the high torque threshold or time limit, the spindle brake engages (according to spindle brake status line 63) and the clutch disengages to prevent the compression belt from loosening. Thus the high pressure attained during uptake of the belt is maintained during the hold period starting at T2. When the belt is loosened at T3 by release of the spindle brake, the intrathoracic pressure drops as indicated by the pressure line. At T4, after the compression belt has loosened to some degree, but not become totally slack, the spindle brake engages to hold the belt at some minimum level of belt pressure. This effectively prevents total relaxation of the patient's chest, maintaining a slightly elevated intra-thoracic pressure even between compression cycles. A period of low level compression is created within the cycle. At p3, the upper threshold is not achieved but the maximum time allowed for compression is reached, and the clutch is engaged for two time periods T9 and T10 until the system releases the clutch based on the time limit. At T9 and T10, the spindle brake, though enabled, is not turned on.

Figures 18, 18A:
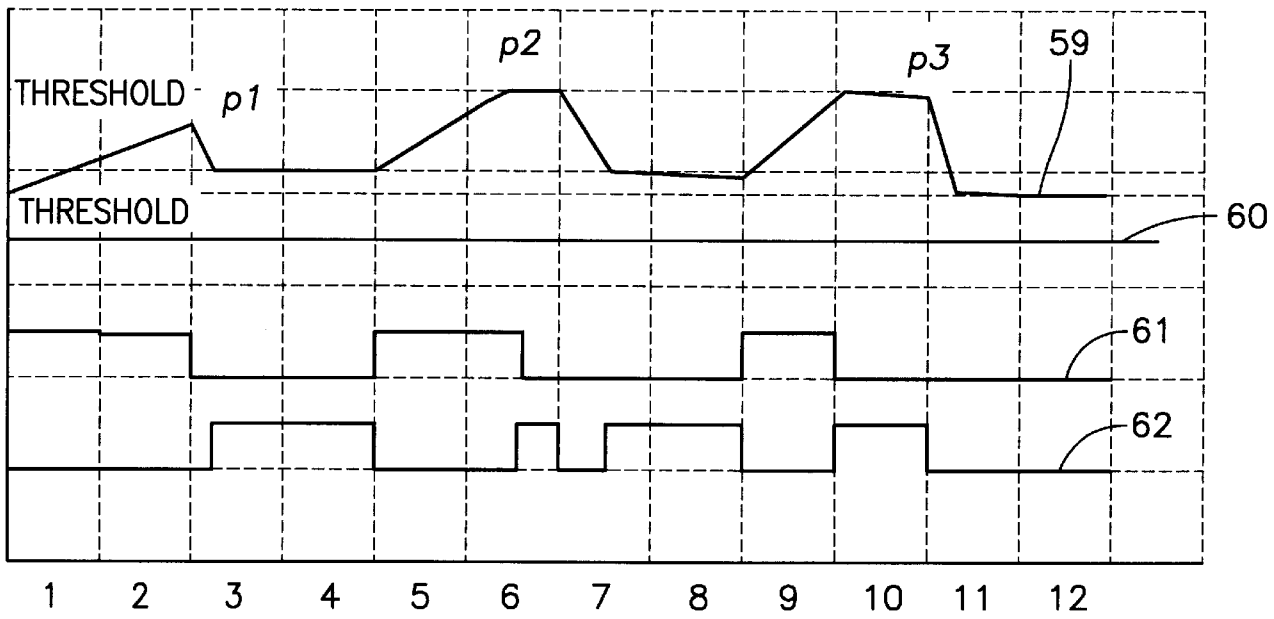
FIG. 18 is a table of the motor and clutch timing for squeeze and hold operation of the compression belt.
FIG. 18*a* is a diagram of the pressure changes developed by the system operated according to the timing diagram of FIG. 18.

FIG. 18 shows a timing table for use in combination with a system that uses the motor, clutch, and secondary brake 53 or a brake on the drive wheel or the spindle itself. The brake 45 is not used in this embodiment of the system (though it may be installed in the motor box). As the table indicates, the motor operates only in the forward direction to tighten the compression belt, and is always on. In the time periods T1 and T2, the motor is on and the clutch is engaged, tightening the compression belt about the patient. In contrast to the timing chart of FIG. 17, the brake is not energized to hold the belt during the compression periods (T1 and T2) unless the upper threshold is achieved by the system. In the next time period T3, the clutch is disengaged and the brake is off to allow the belt to relax and expand with the natural relaxation of the patient's chest. The drive spool will rotate to pay out the length of belt necessary to accommodate relaxation of the patient's chest. During T3, the belt pays out to the zero point, so the system energizes the spindle brake. During T4, the motor remains on, the clutch is disengaged, and the spindle brake is effective to lock the belt to prevent the belt from becoming completely slack (in contrast to the systems using the cam brake, the operation of the spindle brake is effective when the clutch is disengaged because the spindle brake is downstream of the clutch). To start the next cycle at T5, the motor is already on and the spindle brake is turned off, the clutch is engaged and another compression cycle begins. The system achieves the high threshold during time period T6, at peak p2, and causes the clutch to release and the spindle brake to engage, thereby holding the belt tight in the high compression state for the remainder of the compression period (T5 and T6). At the end of the compression period, the brake is momentarily disengaged to allow the belt to expand to the low threshold or zero point, and the brake is engaged again to hold the belt at the low threshold point. Pulse p3 is created with another compression period in which brake is released and the clutch is engaged in T9 and T10, until the threshold is reached, whereupon the clutch disengages and the brake engages to finish the compression period with the belt held in the high compression state. In time period T11 and T12, the clutch is disengaged and the brake is released to allow the chest to relax completely. This provides for a respiration pause in which the patient may be ventilated.

FIG. 18*a* illustrates the intrathoracic pressure and belt strain that corresponds to the operation of the system according to FIG. 18. In time periods T1 and T2, the motor status line 60 and the brake status line 62 indicate that the motor tightens the compression belt up the end of the compression period (the system will not initiate a hold below the upper threshold). When the belt is loosened at T3 by release of the spindle brake, the intrathoracic pressure drops as indicated by the pressure line. At T3, after the compression belt has loosened to some degree, but not become totally slack, the spindle brake engages to hold the belt at some minimum level of belt pressure. This effectively prevents total relaxation of the patient's chest, maintaining a slightly elevated intra-thoracic pressure even between compression cycles. A period of low level compression is created within the cycle. Motor status line 60 and the brake status line 62 indicate that when the motor tightens the compression belt up to the high torque threshold or time limit, the spindle brake engages (according to spindle brake status line 63) and the clutch disengages to prevent the compression belt from loosening. Thus the high pressure attained during uptake of the belt is maintained during the hold period starting at T6. When the belt is loosened at T7 by release of the spindle brake, the intrathoracic pressure drops as indicated by the pressure line. At T7, after the compression belt has loosened to some degree, but not become totally slack, the spindle brake engages to hold the belt at the lower threshold. At p3, the upper threshold is again achieved, and the clutch is disengaged and the brake is engaged at time T10 to initiate the high compression hold.

Figures 19, 19A:
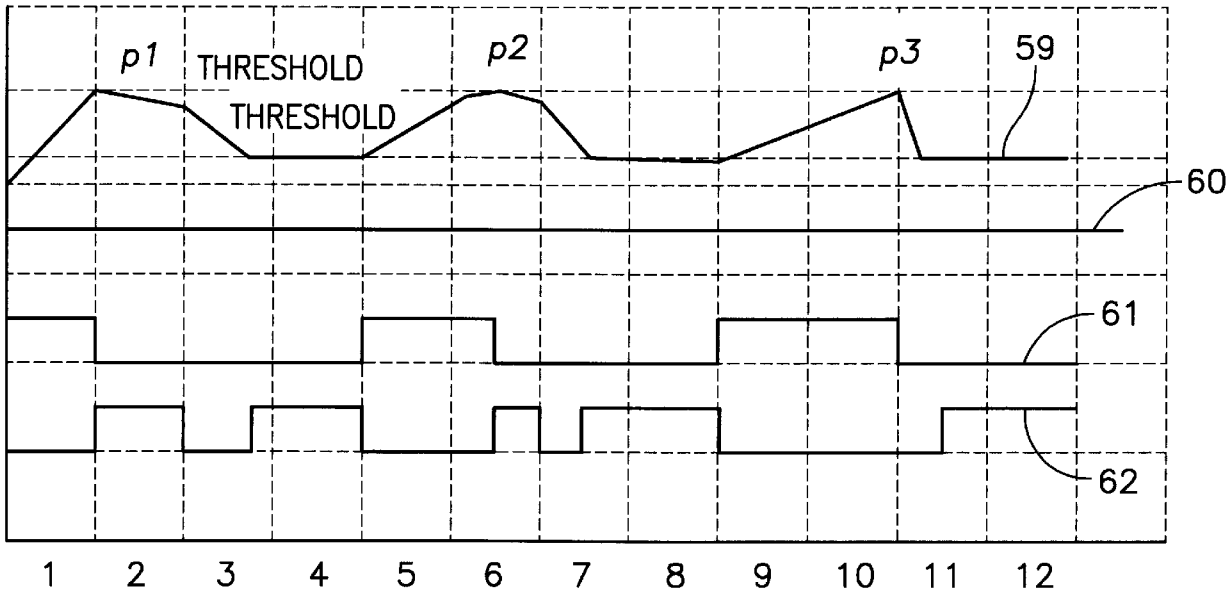
FIG. 19 is a table of the motor and clutch timing for squeeze and hold operation of the compression belt.
FIG. 19*a* is a diagram of the pressure changes developed by the system operated according to the timing diagram of FIG. 19.

FIG. 19 shows a timing table for use in combination with a system that uses the motor, clutch, and secondary brake 53 or a brake on drive wheel or the spindle itself. The brake 45 is not used in this embodiment of the system (though it may be installed in the motor box). As the table indicates, the motor operates only in the forward direction to tighten the compression belt, and is always on. In the first time period T1, the motor is on and the clutch is engaged, tightening the compression belt about the patient. In the next time period T2, the motor is on, the clutch is disengaged in response to the sensed threshold, and the brake 53 is enabled and energized to lock the compression belt in the tightened position only if the upper threshold is sensed during the compression period. In the next time period T3, the clutch is disengaged and the brake is off to allow the belt to relax and expand with the natural relaxation of the patient's chest. The drive spool will rotate to pay out the length of belt necessary to accommodate relaxation of the patient's chest. In the next period t4, while the motor is still on, the clutch is disengaged, but energizing the spindle brake is effective to lock the belt prevent the belt from becoming completely slack (in contrast to the systems described above, the operation of the spindle brake is effective when the clutch is disengaged because the spindle brake is downstream of the clutch). To start the next cycle at T5, the motor is already on and the spindle brake is turned off, the clutch is engaged and another compression cycle begins. During pulse p3, the clutch is on in time period T9. The clutch remains engaged and the brake is enabled but not energized in time period T10. The clutch and brake are controlled in response to the threshold, meaning that the system controller is awaiting until the high threshold is sensed before switching the system to the hold configuration in which the clutch is released and the brake is energized. In this example, the high threshold is not achieved during the compression period T9 and T10, so the system does not initiate a hold.

FIG. 19*a* illustrates the intrathoracic pressure and belt strain that corresponds to the operation of the system according to FIG. 19. Motor status line 60 and the brake status line 62 indicate that when the motor tightens the compression belt up to the high torque threshold or time limit, where the clutch disengages and the spindle brake engages (according to spindle brake status line 63) to prevent the compression belt from loosening. Thus the high pressure attained during uptake of the belt is maintained during the hold period starting at T2. Thus the period of compression comprises a period of active compressing of the chest followed by a period of static compression. When the belt is loosened at T3 by release of the spindle brake, the intrathoracic pressure drops as indicated by the pressure line. At T4, after the compression belt has loosened to some degree, but not become totally slack, the spindle brake engages to hold the belt at some minimum level of belt pressure. This effectively prevents total relaxation of the patient's chest, maintaining a slightly elevated intra-thoracic pressure even between compression cycles. A period of low level compression is created within the cycle. Note that in cycles where the upper threshold is not achieved, the compression period does not include a static compression (hold) period, and the clutch is engaged for two time periods T9 and T10, and the system eventually ends the active compression based on the time limit set by the system.

Figures 20, 20A:
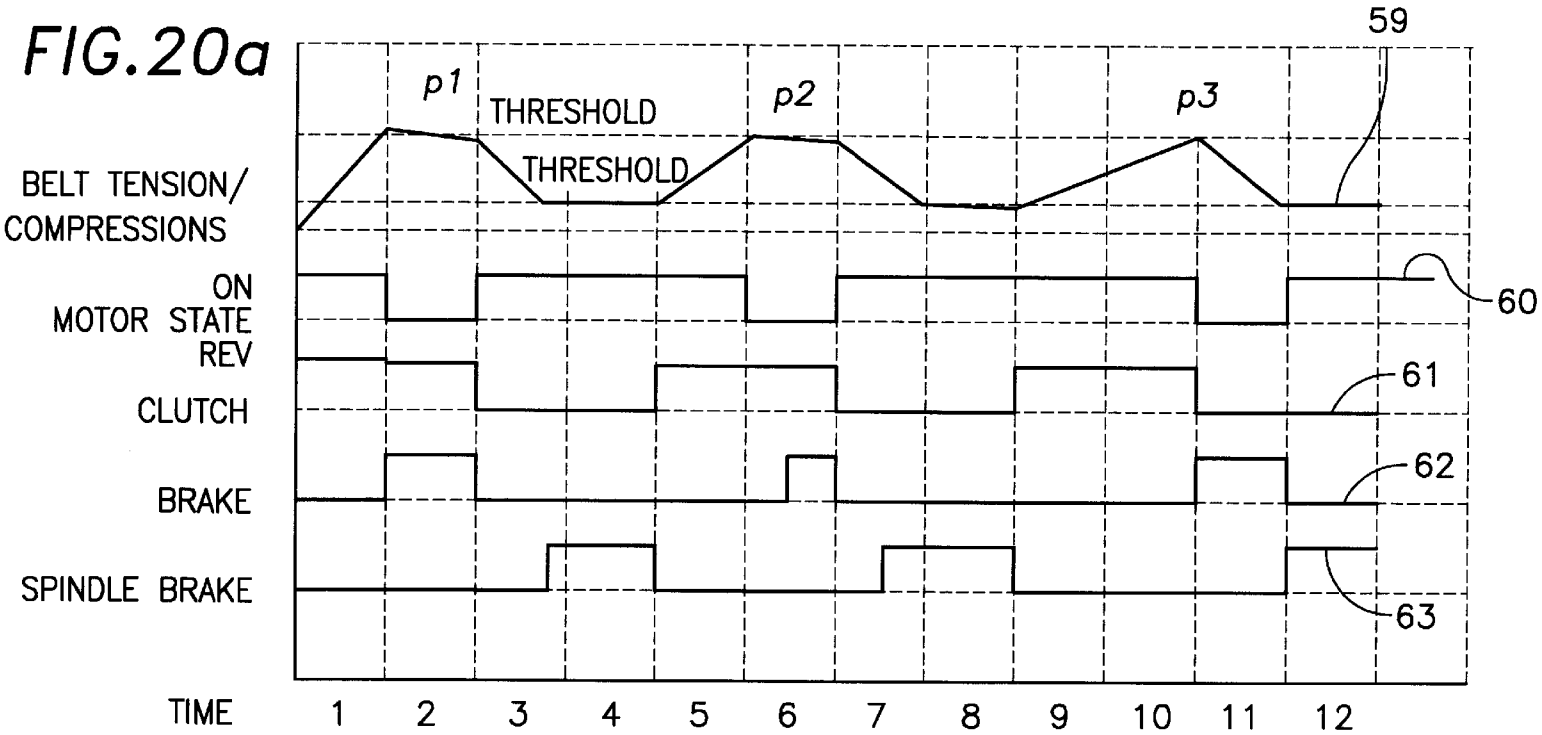
FIG. 20 is a table of the motor and clutch timing for squeeze and hold operation of the compression belt.
FIG. 20*a* is a diagram of the pressure changes developed by the system operated according to the timing diagram of FIG. 20.

FIG. 20 shows a timing table for use in combination with a system that uses the motor, clutch, the brake 45 and secondary brake 53 or a brake on drive wheel or the spindle itself. Both brakes are used in this embodiment of the system. As the table indicates, the motor operates only in the forward direction to tighten the compression belt. In the first time period T1, the motor is on and the clutch is engaged, tightening the compression belt about the patient. In the next time period T2, the upper threshold is achieved and the motor is turned off in response to the sensed threshold, the clutch is still engaged, and the secondary brake 53 is enabled and energized to lock the compression belt in the tightened position (these events happens only if the upper threshold is sensed during the compression period). In the next time period T3, with the clutch disengaged and the brakes off, the belt relaxes and expands with the natural relaxation of the patient's chest. The drive spool will rotate to pay out the length of belt necessary to accommodate relaxation of the patient's chest. In the next period t4 (while the motor is still on), the clutch remains disengaged, but energizing the secondary brake is effective to lock the belt to prevent the belt from becoming completely slack. To start the next cycle at T5, the spindle brake is turned off, the clutch is engaged and another compression cycle begins (the motor has been energized earlier, in time period T3 or T4, to bring it up to speed). During pulse p3, the clutch is on in time period T9. The clutch remains engaged and the brake is enabled but not energized in time period T10. The clutch and brake are controlled in response to the threshold, meaning that the system controller is awaiting until the high threshold is sensed before switching the system to the hold configuration in which the clutch is released and the spindle brake is energized, and the motor is stopped. In this example, the high threshold is not achieved during the compression period T9 and T10, so the system does not initiate a hold. The cam brake serves to hold the belt in the upper threshold length, and the spindle brake serves to hold the belt in the lower threshold length.

FIG. 20*a* illustrates the intrathoracic pressure and belt strain that corresponds to the operation of the system according to FIG. 20. Motor status line 60 and the brake status line 62 indicate that when the motor tightens the compression belt up to the high torque threshold or time limit, the motor turns off and the cam brake engages (according to cam brake status line 62) to prevent the compression belt from loosening (the clutch remains engaged). Thus the high pressure attained during uptake of the belt is maintained during the hold period starting at T2. Thus the period of compression comprises a period of active compressing of the chest followed by a period of static compression. When the belt is loosened at T3 by release of the clutch, the intrathoracic pressure drops as indicated by the pressure line. At T4, after the compression belt has loosened to some degree, but not become totally slack, the spindle brake engages to hold the belt at some minimum level of belt pressure, as indicated by the spindle brake status line 63. This effectively prevents total relaxation of the patient's chest, maintaining a slightly elevated intra-thoracic pressure even between compression cycles. A period of low level compression is created within the cycle. Note that in cycles where the upper threshold is not achieved, the compression period does not include a static compression (hold) period, and the clutch is engaged for two time periods T9 and T10, and the system eventually ends the active compression based on the time limit set by the system.

Figures 21, 21A:
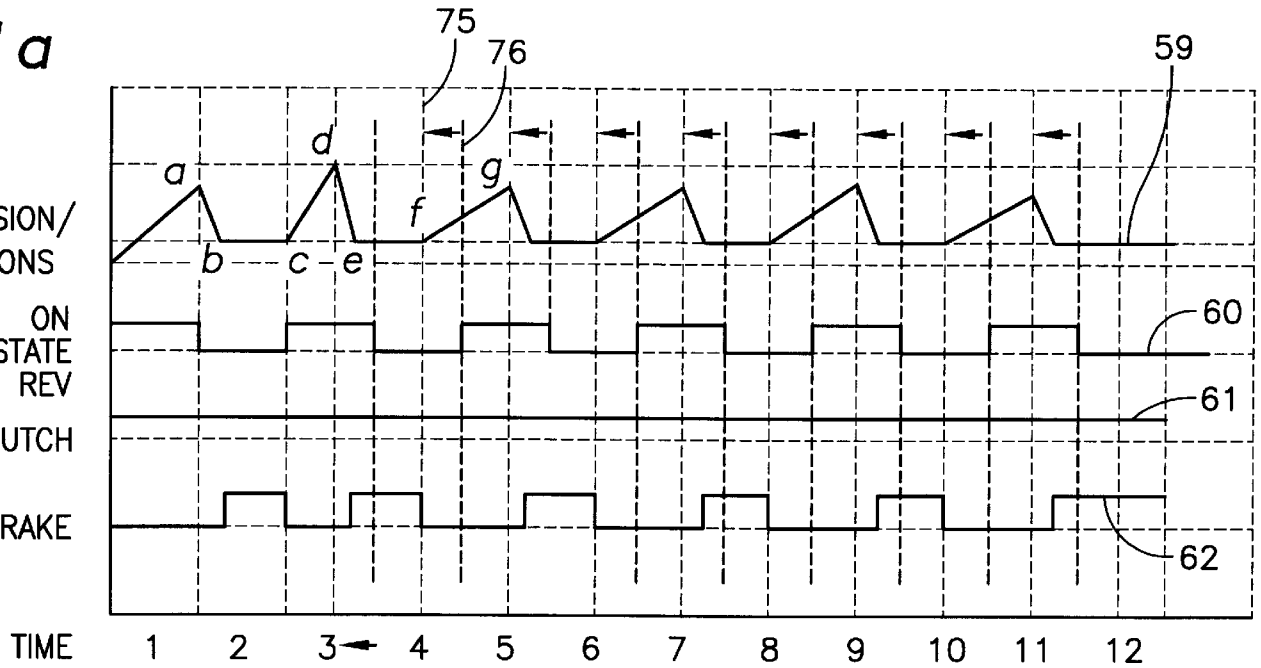
FIG. 21 is table of the motor and clutch timing for operation of the compression belt in an embodiment in which the system timing is reset each time an upper threshold is achieved.
FIG. 21*a* is a diagram of the pressure changes developed by the system operated according to the timing diagram of FIG. 21.

The previous figures have illustrated control systems in a time dominant system, even where thresholds are used to limit the active compression stroke. We expect the time dominant system will be preferred to ensure a consistent number of compression periods per minute, as is currently preferred in the ACLS. Time dominance also eliminates the chance of a runaway system, where the might be awaiting indication that a torque or encoder threshold has been met, yet for some reason the system does not approach the threshold. However, it may be advantageous in some systems, perhaps with patients closely attended by medical personnel, to allow the thresholds to dominate partially or completely. An example of partial threshold dominance is indicated in the table of FIG. 21. The compression period is not timed, and ends only when the upper threshold is sensed at point A. The system operates the clutch and brake to allow relaxation to the lower threshold at point B, and then initiates the low threshold hold period. At a set time after the peak compression, a new compression stroke is initiated at point C, and maintained until the peak compression is reached at point D. The actual time spent in the active compression varies depending on how long it takes the system to achieve the threshold. Thus cycle time (a complete period of active compression, release and low threshold hold, until the start of the next compression) varies with each cycle depending on how long it takes the system to achieve the threshold, and the low threshold relaxation period floats accordingly. To avoid extended periods in which the system operates in tightening mode while awaiting an upper threshold that is never achieved, an outer time limit is imposed on each compression period, as illustrated at point G, where the compression is ended before reaching the maximum allowed compression. In essence, the system clock is reset each time the upper threshold is achieved. The preset time limits 75 for low compression hold periods are shifted leftward on the diagram of FIG. 21*a*, to floating time limits 76. This approach can be combined with each of the previous control regimens by resetting the timing whenever those systems reach the upper threshold. An upper hold period can be added to the method illustrated in this example, and the hold period can float (the upper threshold hold is maintained for a specific time) or end as necessary to permit the system to maintain as many compression periods per minute as desired.

The arrangement of the motor, cam brake and clutch may be applied to other systems for belt driven chest compressions. For example, Lach, Resuscitation Method And Apparatus, U.S. Pat. No. 4,770,164 (Sep. 13, 1988) proposes a hand-cranked belt that fits over the chest and two chocks under the patient's chest. The chocks hold the chest in place while the belt is cranked tight. Torque and belt tightness are limited by a mechanical stop which interferes with the rotation of the large drive roller. The mechanical stop merely limits the tightening roll of the spool, and cannot interfere with the unwinding of the spool. A motor is proposed for attachment to the drive rod, and the mate between the motor shaft and the drive roller is a manually operated mechanical interlock referred to as a clutch. This "clutch" is a primitive clutch that must be set by hand before use and cannot be operated during compression cycles. It cannot release the drive roller during a cycle, and it cannot be engaged while the motor is running, or while the device is in operation. Thus application of the brake and clutch arrangements described above to a device such as Lach will be necessary to allow that system to be automated, and to accomplish the squeeze and hold compression pattern.

Lach, Chest Compression Apparatus for Cardiac Arrest, PCT App. PCT/US96/18882 (Jun. 26. 1997) also proposes a compression belt operated by a scissor-like lever system, and proposes driving that system with a motor which reciprocatingly drives the scissor mechanism back and forth to tighten and loosen the belt. Specifically, Lach teaches that failure of full release is detrimental and suggests that one cycle of compression would not start until full release has occurred. This system can also be improved by the application of the clutch and brake systems described above. It appears that these and other belt tensioning means can be improved upon by the brake and clutch system. Lach discloses a number of reciprocating actuators for driving the belt, and requires application of force to these actuators. For example, the scissor mechanism is operated by applying downward force on the handles of the scissor mechanism, and this downward force is converted into belt tightening force by the actuator. By motorizing this operation, the advantages of our clutch and brake system can be obtained with each of the force converters disclosed in Lach. The socketed connection between the motor and drive spool can be replaced with a flexible drive shaft connected to any force converter disclosed in Lach.

Figure 22:
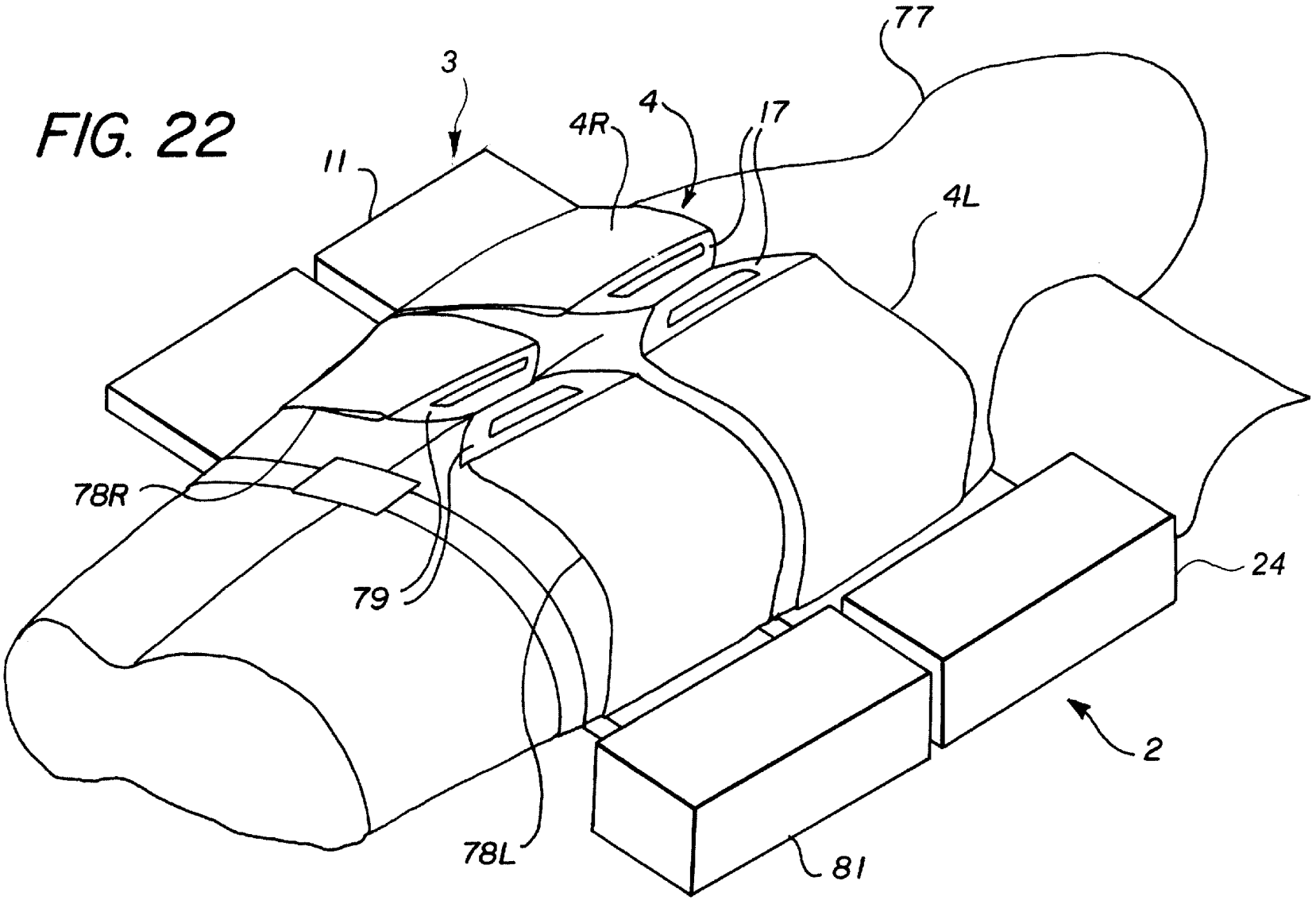
FIG. 22 is an illustration of the chest compression device in combination with an abdominal compression device, shown installed on a patient.

FIG. 22 is an illustration of the chest compression device in combination with an abdominal compression device, shown installed on a patient. The chest compression device is comparable to the chest compression device described in relation to FIGS. 1 through 12*b*. FIG. 22 shows the system mounted on a patient 77 and ready for use. The chest compression subsystem comprises the motor box 24, the belt cartridge and the chest compression belt 4 with left and right portions 4L and 4R. The belt is fastened around the patient with fasteners (quick release fittings) 17 which may be buckles, Velcro hook and loop fasteners or other fasteners with sensors to sense when the belt is fastened. The drive spool which spools the belt is covered within the motor box. The spindles which control the direction of the belt movement are mounted within the back plate 11, which may be comprised of left and right panels (as described above), or may be provided as a backboard suitable for carrying the patient (in which case it would be longer than shown, and extend along the patient's body to provide support for the head, torso and legs). The entire unit may be integrated into a gurney, transfer bed, transfer board, or spine board.

An abdominal compression belt 78 is adapted to extend circumferentially around the patient's abdomen. Left and right belt portions 78L and 78R extend over the patient's left and right side respectively. The belt is fastened around the patient with fasteners (quick release fittings) 79. Abdominal drive spool 80 (shown in FIG. 23) extends along the side of the patient (or located within the backboard, under the patient in line with the spine), and engages the abdominal compression belt so that rotation of the spool causes the belt to wrap around the spool, taking up a length of the belt and causing the remaining unspooled portion of the belt to constrict around the abdomen. Guide spindles, clutches, and other mechanisms used to control the abdominal compression belt are housed within the motor box 81, which is comparable to the motor box 2 of FIG. 1. The various drive spool and clutch arrangements that enable coordinated operation of the two belts are illustrated in the following figures.

Figure 23:
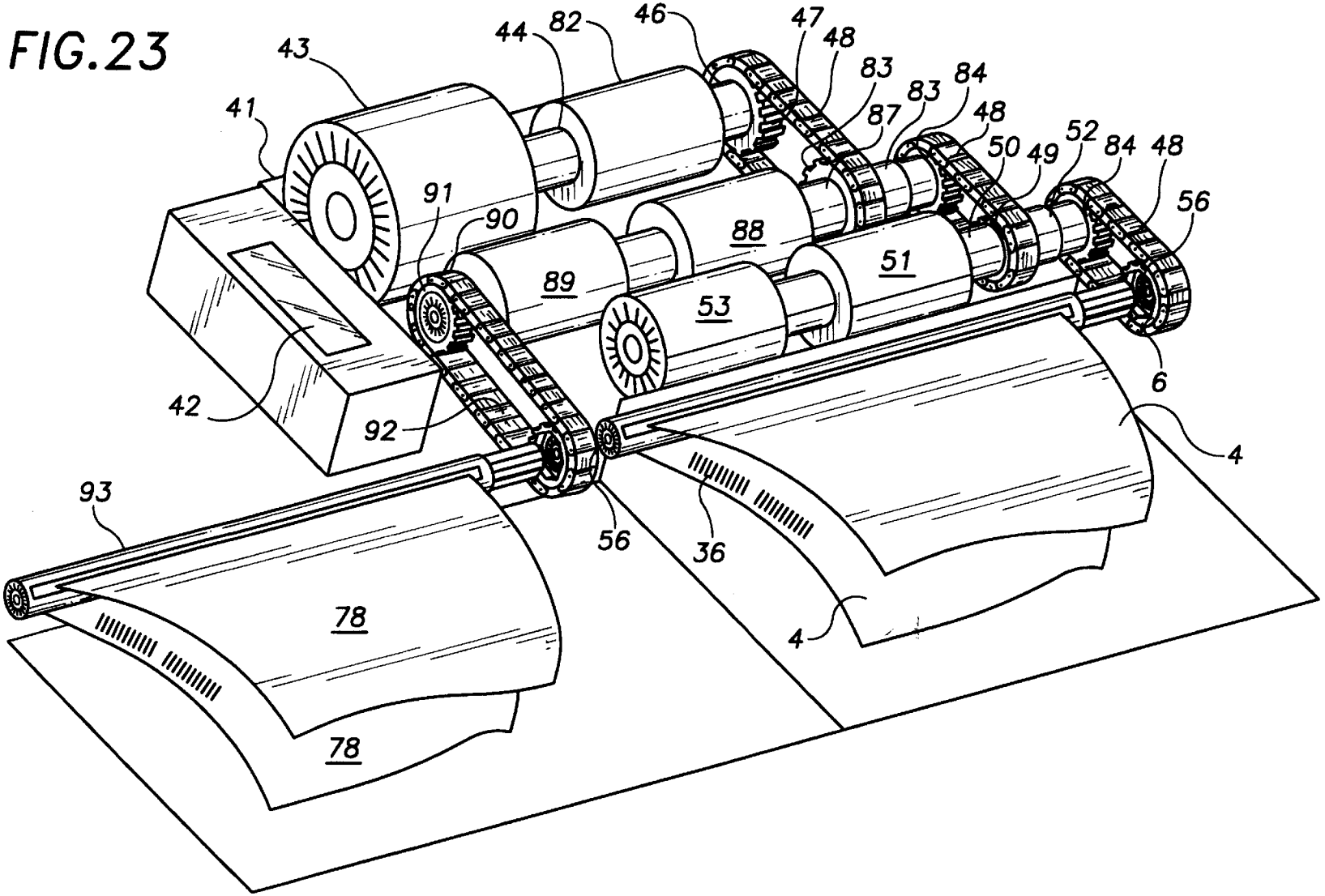
FIG. 23 is an illustration of the combined chest compression and abdominal compression system using a single motor.

FIG. 23 shows a perspective view of the counterpulsion device, with the motor box cover removed to display the operating mechanisms. The motor 43 turns the motor shaft 44 is lined up directly to the gear box 82 (which may include a cam brake 45, as described above). The gearbox output rotor 46 connects to a wheel 47 and chain 48 which connects to and drives an intermediate input gear 83 and an intermediate shaft 84 which connects intermediate transmission wheel 85. The intermediate shaft drives both the chest drive chain 86 and the abdominal drive train. The chest drive chain engages the input wheel 49, and thereby to the transmission rotor 50 of the clutch 51. The clutch 51 controls whether the input wheel 49 engages the output 52, and whether rotary input to the input wheel is transmitted to the output wheel. (The chest brake 53 is operable to lock the chest drive spool in place, and prevent unwinding, as explained below in reference to FIG. 17.) The output wheel 52 is connected to the drive spool 8 via the chain 54 and drive wheel 6 and receiving rod 7 (the drive rod is on the cartridge). The drive wheel 6 has receiving socket 5 which is sized and shaped to mate and engage with the drive rod 7. The gear box output shaft and chain also drive an abdominal drive train including the gear driven shaft 87 which is operably connected to the intermediate input gear 83 through a second clutch 88 (referred to as the abdominal clutch for convenience) and a second brake 89 (referred to as the abdominal brake for convenience). The abdominal belt drive train output shaft 90 and output gear 91 drive the abdominal drive chain 92, which in turn drives abdominal drive spool 93. The abdominal drive spool will be driven by the motor when the abdominal clutch is engaged and the abdominal brake is off. The abdominal brake may be engaged to lock the abdominal belt in place, either in response to feedback from the patient or the device (a sensed parameter of the patient indicating that the maximum desired compression has been reached) or in response to feedback from the device itself, or on a timed basis. Note that the abdominal clutch and abdominal brake are lined up opposite to the output shaft compared to the chest clutch and the chest brake. This is possible given the construction of the brake and the clutch (the wrap spring magnetic brake and clutch available from Warner Electric). The arrangement of the abdominal clutch and abdominal brake allow the abdominal drive spool to be locked in position with the brake while the clutch disconnects the system from the chest drive chain, thus permitting the chest compressions to occur while the abdominal spool is braked. An encoder is mounted on the abdominal drive spool 93 (on either end) to sense the rotational position of the drive spool and transmit a corresponding signal to the controller for use in limiting the amount of abdominal compression applied. Slack take-up of the abdominal belt is achieved with a slack take-up cycle, in which encoder rate or motor torque is monitored to established pre-tightened position, in the same manner as applied to the chest compression belt.

The system is powered by battery 94, and controlled by a controller housed within the box. The controller is a computer module which is programmed to operate the motor, clutches and brakes in order to spool the chest compression belt and the abdominal compression belt upon their respective spools in a sequence which optimizes blood flow within the body of the patient. The single motor shown in FIG. 23 can be used to drive both spools to perform chest compression and abdominal compression by programming the computer module to operate the components as desired. For example, to operate the system to provide chest compressions with alternating abdominal compressions (counterpulsion) the motor is energized to run, and the chest clutch 51 is engaged to spin the chest compression drive spool and spool the chest compression belt around the spool. When the chest compression belt is drawn tightly about the chest (as indicated by force feedback (from the belt or from the patient) or torque feedback from the motor), the controller engages brake 1, keeping clutch 1 engaged, thereby stopping the tightening of the chest compression belt and preventing it from loosening for a brief period defined above as a high compression hold period, then disengaging the clutch to allow the chest compression belt to relax and loosen with the natural expansion of the chest. The controller may initiate a counterpulsion abdominal compression by engaging the abdominal clutch 88 to spin the abdominal compression drive spool 93 and spool the abdominal compression belt around the spool. When the abdominal compression belt is drawn tightly about the abdomen (as indicated by force feedback or torque feedback from the motor), the controller disengages the abdominal brake 89 and/or engages the abdominal clutch 88. The sequence can be adjusted and modified to accomplish several compression sequences, depending on clinical indications. The abdominal compression may be initiated during the high compression hold applied to the chest, by causing the abdominal clutch 88 to engage prior to disengaging the chest clutch at the end of the hold period. Abdominal compression can be accomplished in synchronized fashion with the chest compressions by engaging the abdominal clutch 88 at the same time the chest clutch is engaged, thus providing dual cavity compression of both the thoracic cavity and the abdominal cavity of the patient. The abdominal compression can be performed by continuously holding the abdominal belt at slight pressure while the chest is repeatedly compressed, thereby effecting abdominal binding. To accomplish abdominal binding, the abdominal clutch 88 is engaged until a predetermined binding compression is obtained (the predetermined compression may be measured and set on the basis of motor torque, strain load on the belt, or encoder position). The binding compression is expected to be somewhat lower than the degree of compression used for counterpulsion. When the binding compression level is achieved, the system operates to disengage the abdominal clutch 88 and engage the abdominal brake 89, thereby holding the belt in binding position. Finally, the abdominal compression may be performed alone, without accompanying chest compressions, to create blood flow within the patients body. (This last method has worked on test animals, in which a single belt was applied to the abdomen of a pig and operated to repeatedly compress and release the abdomen, creating considerable measurable blood flow within the pig.)

Figure 24:
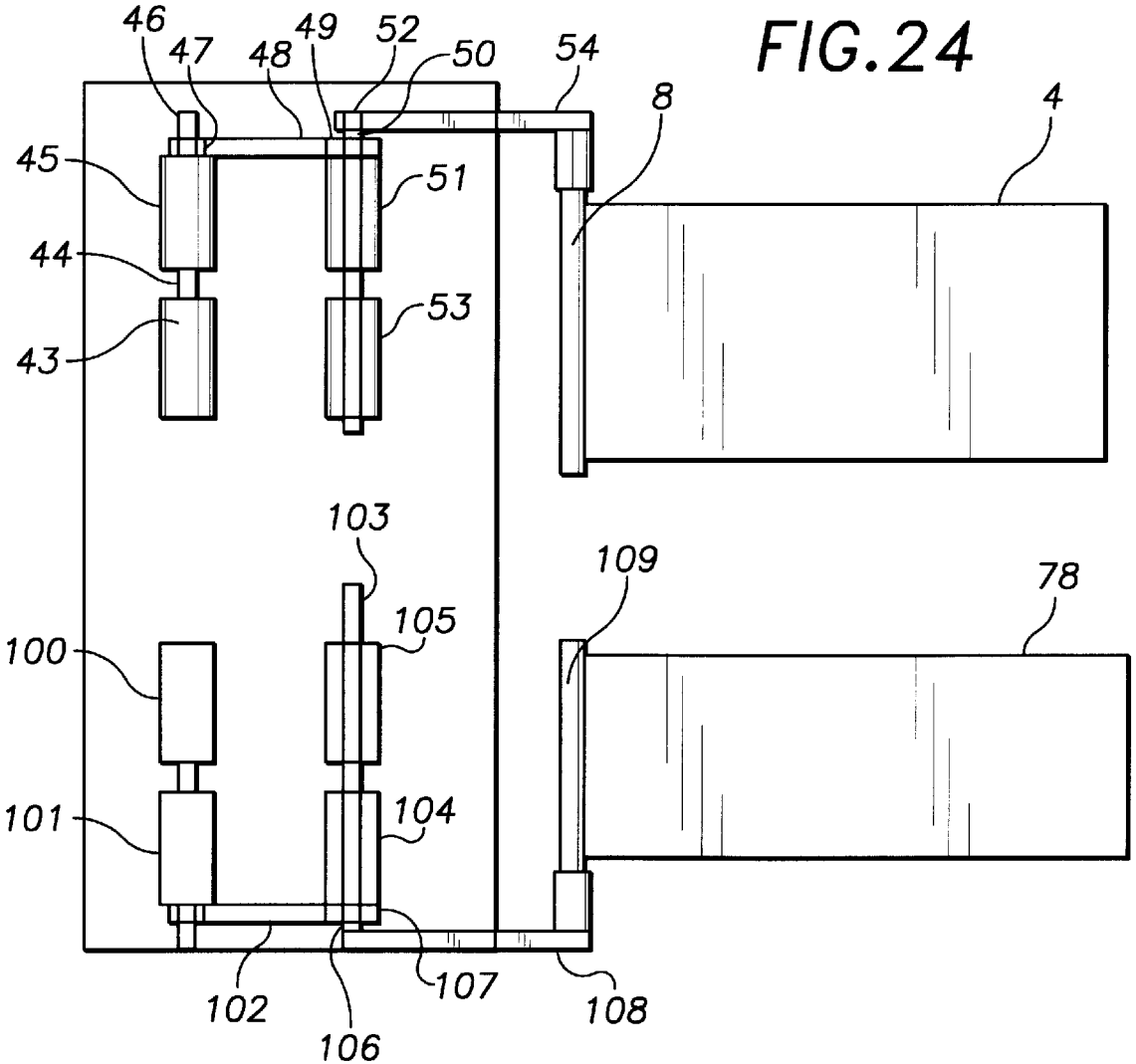
FIG. 24 is an illustration of the combined chest compression and abdominal compression system using two motors.

FIG. 24 illustrates another construction of a combined chest compression and abdominal compression device using two motors. This device uses a separate motor for each compression belt, enabling multiple waveforms of compression. The timing of the belts can be controlled to provide thoracic compression with abdominal counterpulsion, simultaneous compression, binding over a number of chest compression cycles, or combinations of these compression patterns. The motor 43 drives the motor shaft 44. The motor shaft 44 is lined up directly to the brake 45 which includes reducing gears and a cam brake. The gearbox output rotor 46 connects to a wheel 47 and chain 48 which connect to the input wheel 49, and thereby to the transmission rotor 50 of the clutch 51. The clutch 51 controls whether the input wheel 49 engages the output wheel 52, and whether rotary input to the input wheel is transmitted to the output wheel. The brake 53 provides for control of the system, as explained above in reference to FIG. 17.) The output wheel 52 is connected to the drive spool 8 via the chain 54 and the drive wheel and receiving rod. A second motor 100 drives an abdominal drive train including a gear box 101 and output shaft and chain a gear 102 and gear driven shaft 103 through a second clutch 104 and a second brake 105. The abdominal belt drive train output shaft 106 and output gear 107 drive the abdominal drive chain 108, which in turn drives abdominal drive spool 109. An encoder may also be mounted on the abdominal drive spool 109 (on either end) to sense the rotational position of the drive spool and transmit a corresponding signal to the controller for use in limiting the amount of abdominal compression applied.

Figure 25:
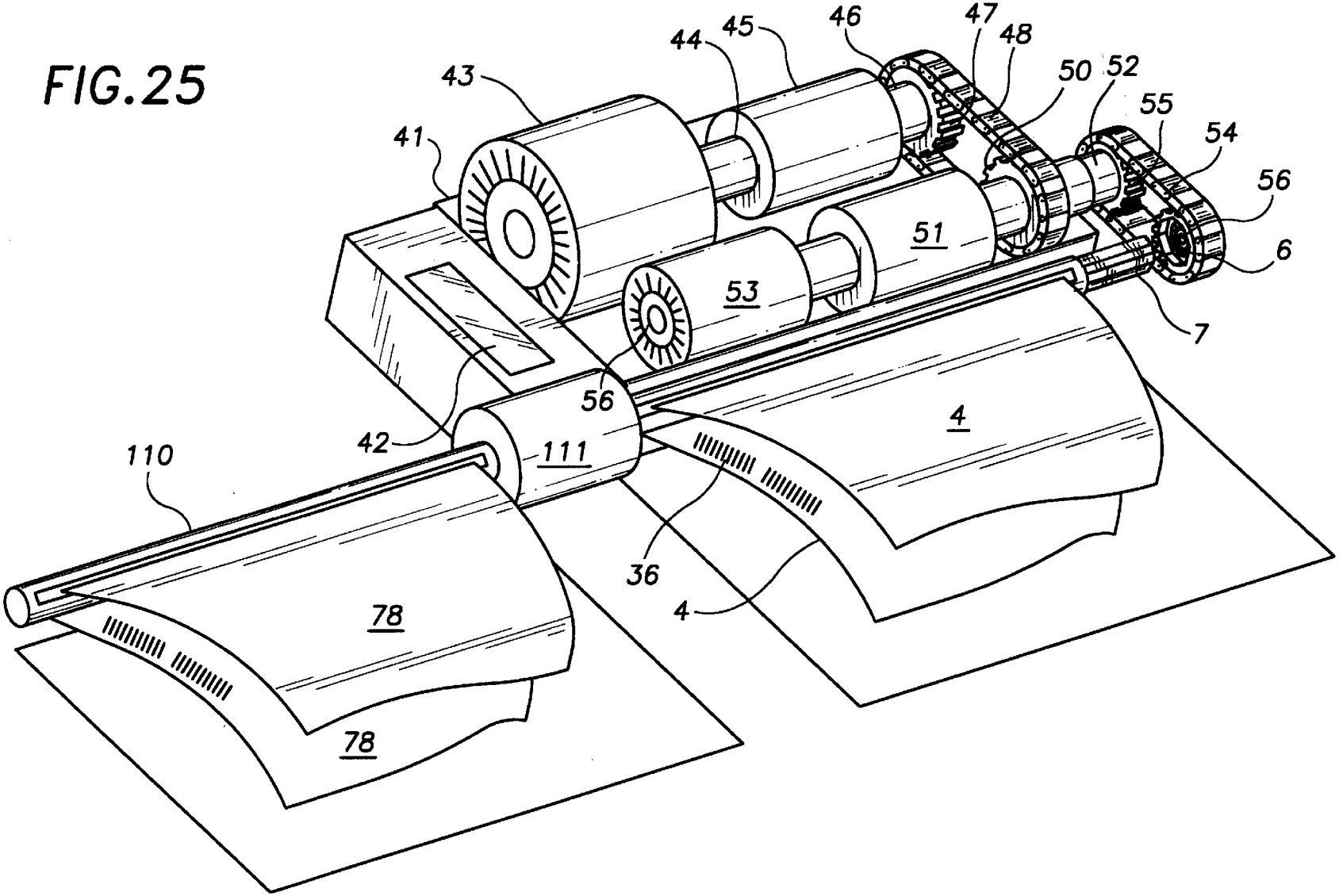
FIGS. 25 and 26 illustrate a combined chest compression and counterpulsion device in which counterpulsion force is derived from the resilient inhalation of the patient on which the device is installed.
Figure 26:
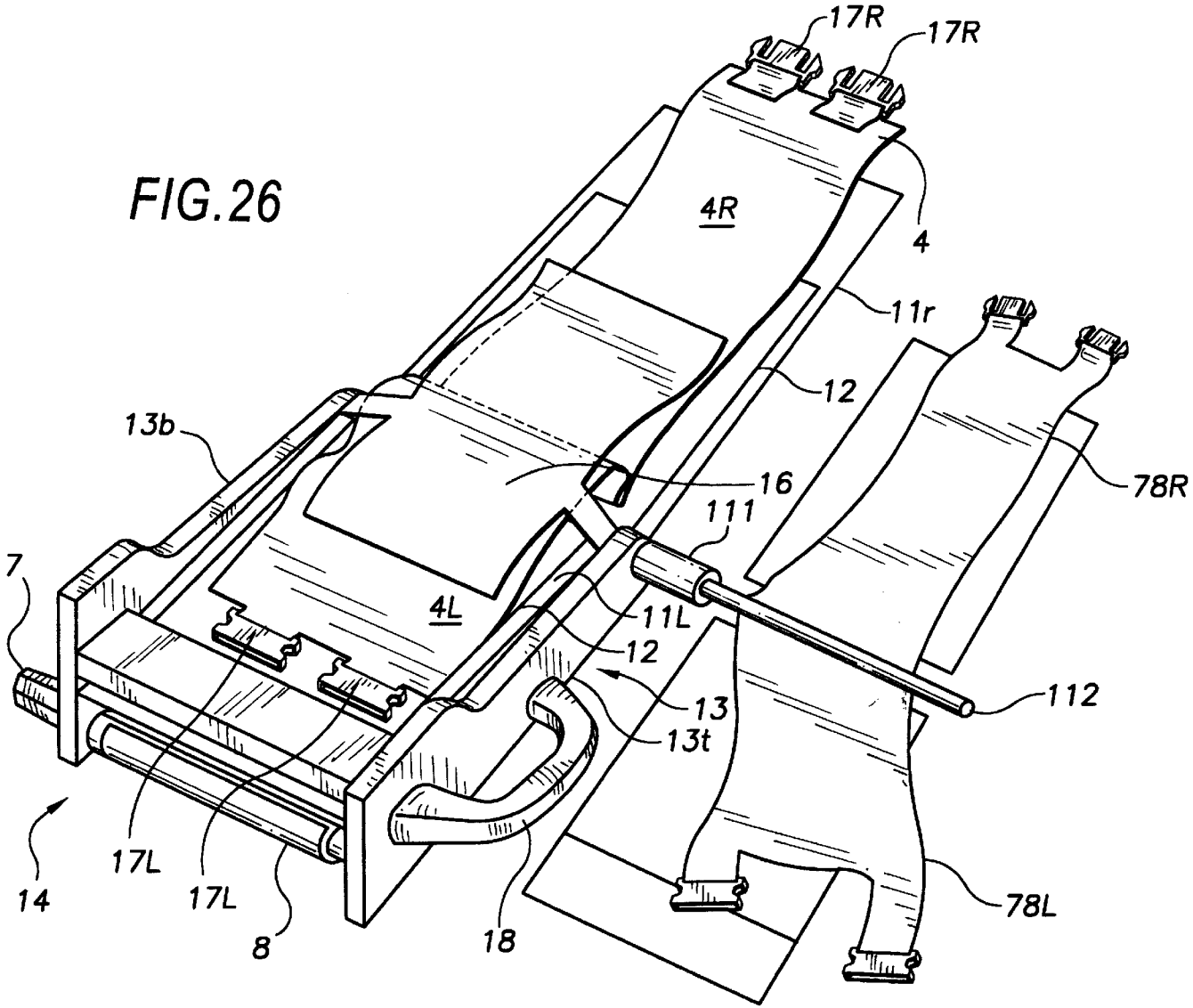

FIG. 25 shows an embodiment of a combined chest compressions and abdominal compression device which uses the natural expansive force and resilience of the patient's chest to drive the abdominal compression belt to accomplish counterpulsion. Again, the device includes the motor 43 drives the motor shaft 44. The motor shaft 44 is lined up directly to the brake 45 which includes reducing gears and a cam brake to control free spinning of the motor when the motor is not energized (or when a reverse load is applied to the gearbox output shaft). The gearbox output rotor 46 connects to a wheel 47 and chain 48 which connect to the input wheel 49, and thereby to the transmission rotor 50 of the clutch 51. The clutch 51 controls whether the input wheel 49 engages the output wheel 52, and whether rotary input to the input wheel is transmitted to the output wheel. (The secondary brake 53, which we refer to as the spindle brake, provides for control of the system in some embodiments, as explained below in reference to FIG. 17.) The output wheel 52 is connected to the drive spool 8 via the chain 54 and drive wheel 6 and receiving rod 7 (the drive rod is on the cartridge). The drive wheel 6 has receiving socket 5 which is sized and shaped to mate and engage with the drive rod 7 This device also includes an abdominal compression belt coupled to the abdominal drive spool so that belt is rolled upon the spool (and therefore tightens around the abdomen) when the drive spool rotates. The chest drive spool is coupled to the abdominal drive spool 110 through a clutch 111. This counterpulsion clutch 111 is controlled by the computer module, and is operated to remain disengaged during compression of the chest (and rotation of the drive spool 8), and to engage during expansion of the chest. When the abdominal belt is secured around the abdomen of the patient before operation begins, tightening of the rotation of the drive spool 8 while the abdominal clutch 111 is disengaged will have no effect on the abdominal belt. When the clutch 51 is released to release the chest compression belt and allow that belt to unwind under the resilient expansive force of the chest, abdominal clutch 111 is engaged to rotationally couple the drive spool 8 with the abdominal drive spool 110. Unwinding of the thoracic drive spool equates with winding of the abdominal drive spool and tightening of the abdominal compression belt. If the abdominal clutch is maintained engaged thereafter, the two belts will operate in opposition, with one belt tightening while the other belt is unwinding. If the abdominal clutch is disengaged prior to each chest compression (about the time the chest clutch is engaged), the abdominal belt will unwind during the chest compression due to the pressure created in the abdomen under the compression stroke. The unwinding of the abdominal belt can be controlled, to avoid excess slack from developing, in the same manner as applied to the chest compression belt. The abdominal belt in the resiliently driven counterpulsion system can be driven off the chest drive spool, as illustrated in FIG. 26. This system can be employed in both the side pull devices of FIG. 12*a* and in the center pull device illustrated in FIGS. 2 and 3. For example, FIG. 26 illustrates connection of the abdominal drive spool to the chest drive spool which operate in either the side pull embodiment or the center pull embodiment. FIG. 26*a* illustrates the resiliently driven counterpulsion device with the abdominal belt being driven by the guide spindle 15 at the anatomical centerline of the cartridge 3. The spindle is connected to the abdominal drive spool 112 through the counterpulsion clutch 111 which operates in the same fashion as the counterpulsion clutch in FIG. 26, except that it operably connects the guide spindle to the abdominal drive spool The devices of the preceding figures illustrate the connections between the abdominal drive spool and chest drive spool and the motor. The drive systems may be included in side pulling devices similar to FIGS. 12*a* and 12*b* by fitting the devices with shields (such as the shield 57) with long apertures guiding the belt into the spool and threading the belt through the apertures. The drive systems may be included in the center pull devices illustrated in FIGS. 2 and 3 by providing the housing 13 and centrally located (i.e., near the patient's spine when in use) spindle 15.

Figure 27A:
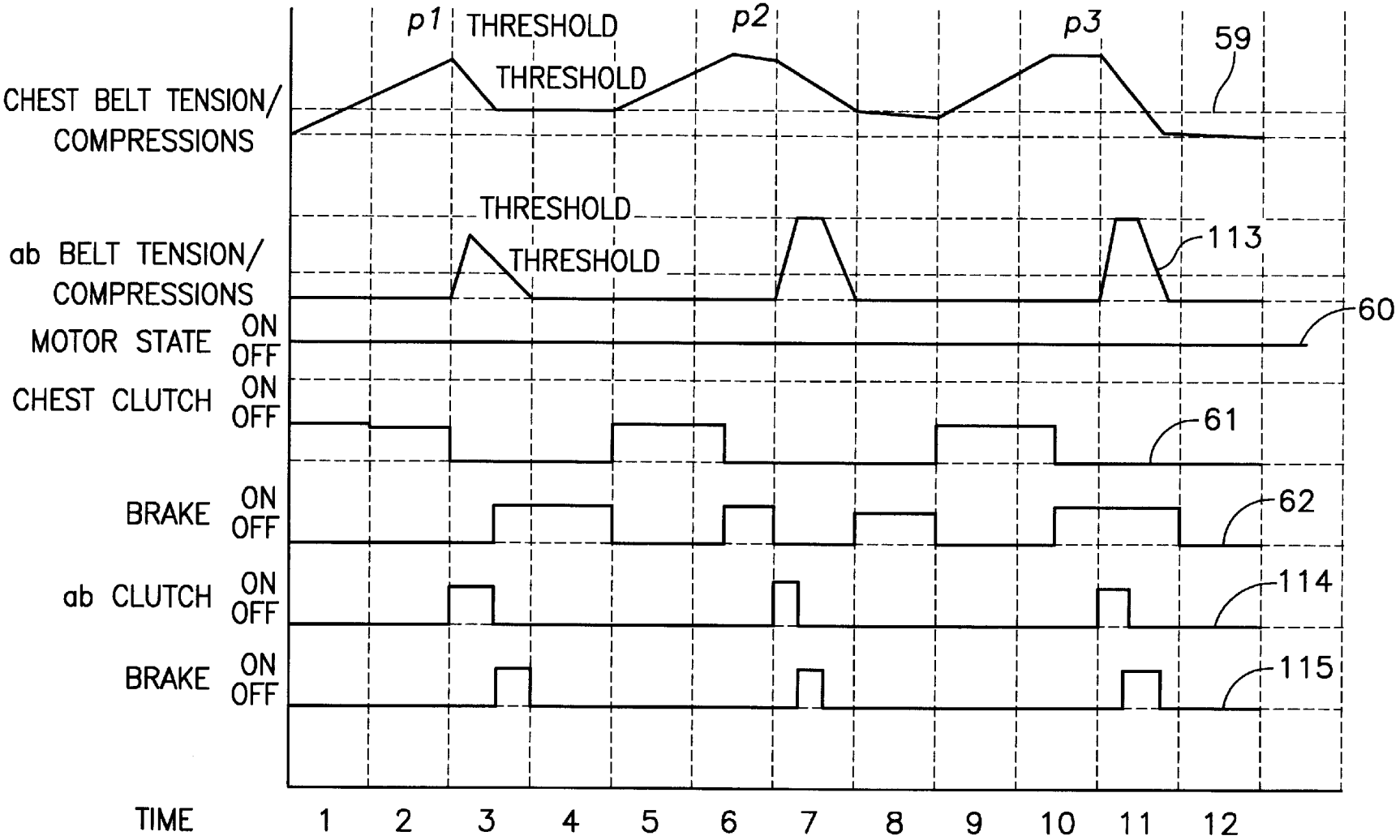

FIGS. 27 and 27*a* illustrate the timing of the operation of the various system components of the CPR/counterpulsion device illustrated in FIG. 23, for example. FIG. 27 shows a timing table for use in combination with a system that uses the motor, clutch, the secondary brake 53 or a brake on drive wheel or the spindle itself to control the chest compression belt, and uses the second clutch 88 and second brake 89 to control the abdominal compression belt. Both brakes are used in this embodiment of the system. The motor operates only in the one direction (the "forward" direction which tightens the chest compression belt). In the first time period T1, the motor is on and the chest clutch is engaged, tightening the compression belt about the patient's chest. In the next time period T2, the upper threshold of compressive force is not achieved (the computer module controlling the system is programmed to monitor the force on the belt, and to turn off the motor in response to the sensed threshold, in which case the clutch is engaged, and the brake 53 is enabled and energized to lock the compression belt in the tightened position (these events happens only if the upper threshold is sensed during the compression period)), so the system continues through time period T2 with the chest clutch engaged. In the next time period T3, with the clutch disengaged and the brake is off, and the chest belt relaxes and expands with the natural relaxation of the patient's chest. The drive spool will rotate to pay out the length of belt necessary to accommodate relaxation of the patient's chest. During time period T3, or in the next period t4 (while the motor is still on), the clutch remains disengaged, but energizing the secondary brake is effective to lock the belt to prevent the chest compression belt from becoming completely slack. The system accomplishes counterpulsion during time periods T3 and T4, by engaging the abdominal clutch, thereby operably coupling the abdominal drive shaft and drive spool to the motor. The abdominal clutch is engaged for a short period, then disengaged (shown here to happen in time period T3). When the clutch is disengaged, the abdominal brake is engaged to hold the abdominal belt taut for a brief period. To start the next cycle at T5, the spindle brake is turned off, the chest clutch is engaged and another chest compression cycle begins (the motor has been energized continuously, in time period T3 or T4). During pulse p2, the clutch is on in time period T5. The clutch remains engaged and the brake is enabled and energized at the start of time period T6. The clutch and brake are controlled in response to the threshold, and the system controller waits until the high threshold is sensed before switching the system to the hold configuration in which the clutch is released and the brake is energized. In this example, the high threshold is sensed during time period T6, so the control module disengages the clutch and engages the brake. In this example, the high threshold is not achieved during the compression period T9 and T10, so the system does not initiate a hold. The single brake serves to hold the belt in the upper threshold length, and also to hold the belt in the lower threshold length.

FIG. 27*a* illustrates the intrathoracic pressure and belt tension that corresponds to the operation of the system according to FIG. 20. Motor status line 60 and the brake status line 113 indicate that when the motor tightens the compression belt up to the high torque threshold or time limit, the motor turns off and the chest brake engages (according to chest brake status line 113) to prevent the compression belt from loosening (the clutch remains engaged). Thus the high pressure attained during uptake of the belt is maintained during the hold period starting at T6, for example. Thus the period of compression comprises a period of active compressing of the chest followed by a period of static compression. When the belt is loosened at T7 by release of the chest clutch, the intrathoracic pressure drops as indicated by the pressure line. At T8, after the compression belt has loosened to some degree, but not become totally slack, the spindle brake engages to hold the belt at some minimum level of belt pressure, as indicated by the spindle brake status line 63. This effectively prevents total relaxation of the patient's chest, maintaining a slightly elevated intra-thoracic pressure even between compression cycles. A period of low level compression is created within the cycle. Note that in cycles where the upper threshold is not achieved, the compression period does not include a static compression (hold) period, and the clutch is engaged for two time periods T1 and T2, and the system eventually ends the active compression based on the time limit set by the system.

Figure 28A:
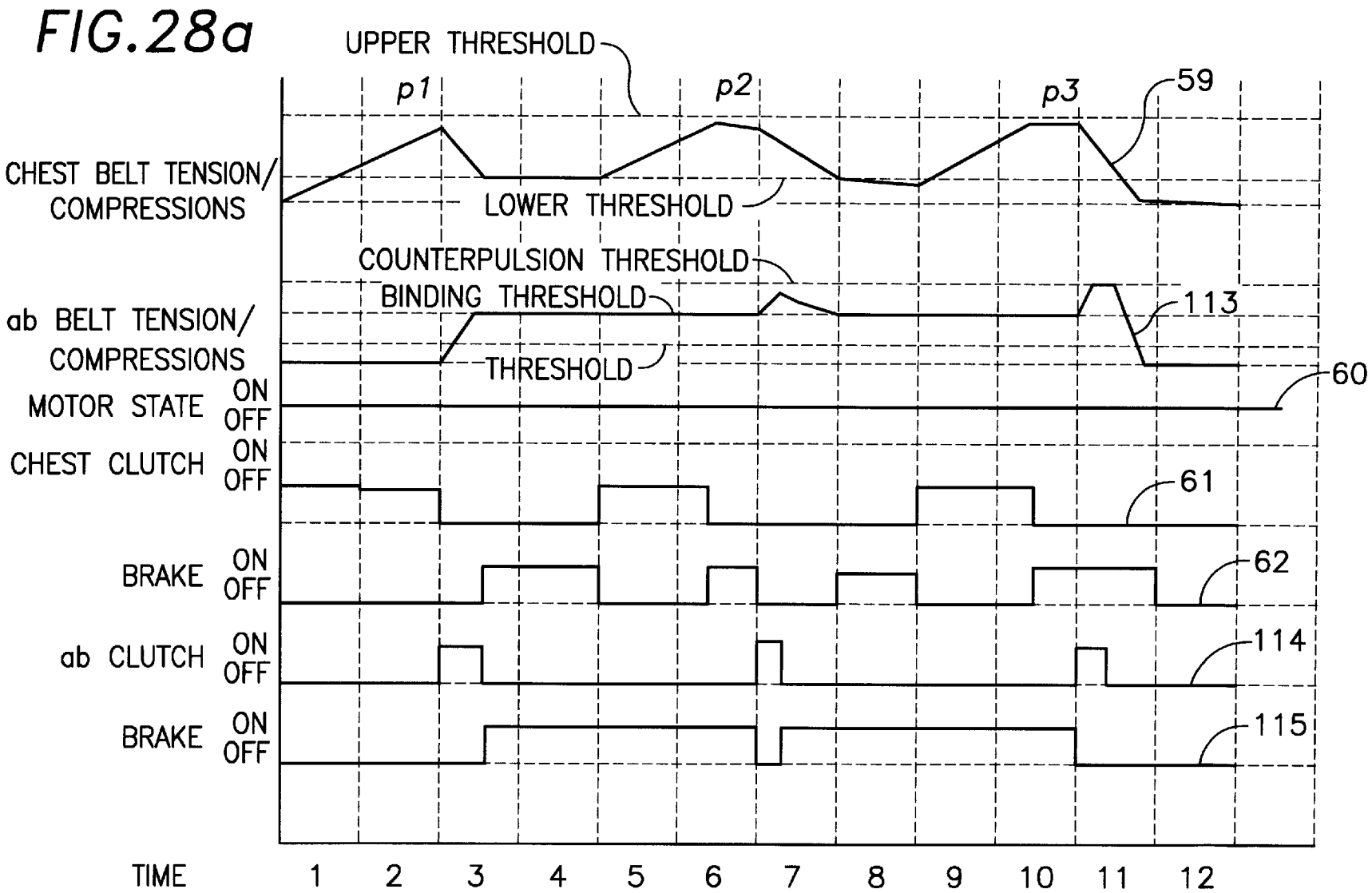

While the chest compression belt is rhythmically compressing the chest, the abdominal compression belt is rhythmically compressing the abdomen. The pressure applied to the abdomen is illustrated in abdominal pressure line 114. After the active compression of the chest is completed, the abdominal clutch is engaged as indicated by ab clutch status line 115 (illustrated as simultaneous with the disengagement of the chest clutch, but may be accomplished shortly before or shortly after), and the abdominal drive spool rotates to spool the abdominal compression belt and constrict the belt about the abdomen. Thus at time T3, the abdominal clutch is energized (the abdominal brake remains de-energized) for a brief period. During the abdominal compression cycle, the current on the motor is monitored (or feed back from some other parameter related to the force applied by the belt, such as from a load cell, strain gauge, etc. is monitored) and the control module disengages the abdominal clutch in response to sensing a set threshold of the applied torque. Upon reaching the abdominal compression threshold, the control module disengages the abdominal clutch and engages the abdominal brake for a brief period to hold the pressure on the abdomen, as indicated by ab brake status line 116. The hold period may be arbitrarily set to any portion of the time remaining prior to initiation of the next chest compression cycle. The abdominal brake may be engaged for longer periods, for example, it may be held through several cycles, so that abdominal compression (actual tightening of the belt) occurs less frequently than the cycles of chest compression (so that several chest compression are accomplished between each abdominal compression). The abdominal brake may also be operated to establish a low compression hold on the abdomen, releasing the abdominal drive spool briefly to allow partial unwinding before re-engaging the drive spool, and then re-engaging the abdominal brake when the low compression state is reached (as sensed by encoders or other feedback mechanisms). Thus combinations of abdominal binding and counterpulsion can be achieved. FIG. 28*a* illustrates how this is accomplished. The chart is the same as the chart of FIG. 27*a*, except in the action of the abdominal brake and abdominal pressure line. The abdominal brake is applied after each engagement of the abdominal clutch. When the abdominal clutch is energized, the abdominal brake is off. After the abdominal clutch is released, the abdominal brake is applied by the system control module when the high compression threshold is sensed, so that a binding pressure is applied to the stomach. The brake remains applied during the next chest compression to apply abdominal binding pressure to the abdomen. The upper threshold of abdominal pressure is set to the desired abdominal binding pressure, and the periods of abdominal clutch engagement will not be very effective for counterpulsion but will be effective to maintain the abdominal belt in position for abdominal binding (that is, the clutch engagement periods will cinch up the belt in case it has loosened).

The abdominal pressure can be applied with a squeeze and hold pattern, with the highest pressure applied to the abdomen held momentarily before release. FIG. 28*a* illustrates how this is accomplished. The chart is the same as the chart of FIG. 27*a*, except in the action of the abdominal brake and abdominal pressure line. The abdominal brake is applied after each engagement of the abdominal clutch.

When the abdominal clutch is energized, the abdominal brake is off. After the abdominal clutch is released, the abdominal brake is applied by the system control module when the upper threshold for abdominal pressure is sensed. The brake remains applied momentarily, and is released prior to the start of the next chest compression. The upper threshold of abdominal pressure is set to the desired abdominal pressure for creating effective counterpulsion action.

The operation of the devices illustrated in FIGS. 23 and 24 may be governed by the timing charts of FIGS. 27 through 27*a*. In devices fitted with a second motor to drive the abdominal drive spool, the motor may be run continuously or intermittently, depending on which situation minimizes the load on the battery. Embodiments may operate using a single motor which reverses direction to unwind the chest compression belt and drive the abdominal compression belt. A reversing motor may be employed with the system, and the clutches and brakes may be operated according to any of the diagrams above.

Thus, while the preferred embodiments of the devices and methods have been described in reference to the environment in which they were developed, they are merely illustrative of the principles of the inventions. Other embodiments and configurations may be devised without departing from the spirit of the inventions and the scope of the appended claims.

We claim:

1. A device for treating a human, said device comprising:

a chest belt adapted to extend around the chest of the patient;

an abdominal belt adapted to extend around the abdomen of the patient;

a first motor-driven drive spool operably connected to the chest belt such that rotation of the drive spool causes the chest belt to spool upon the first drive spool, and connected to a motor;

a second motor-driven drive spool operably connected to the abdominal belt such that rotation of the drive spool causes the abdominal belt to spool upon the second drive spool, and connected to a motor;

a computer module which controls the operation of the chest belt and the abdominal belt to cause the chest belt to be spooled upon the first drive spool and unspooled from the first drive spool and cause the abdominal belt to be spooled upon the second drive spool and unspooled from the second drive spool;

wherein the first drive spool and the second drive spool are operably connected to a single motor through a first clutch and a second clutch, said first clutch connecting the motor to the first drive spool, and said second clutch connecting the motor to the second drive spool;

wherein the first clutch is operable to disconnect the motor from the first drive spool while the motor is operating, and is operable to connect the motor to the first drive spool while the motor is operating;

wherein said motor and first clutch are operable to alternatingly rotate the first drive spool in a direction causing the compression belt to constrict around the chest of the patient, and permit the spool to spin in a direction causing the compression belt to loosen around the chest of the patient, wherein said alternate rotations of the first drive spool in the direction causing constriction and rotations of the first drive spool in the direction permitting relaxation occur while the motor is operating;

the second clutch is operable to disconnect the motor from the second drive spool while the motor is operating, and is operable to connect the motor to the second drive spool while the motor is operating;

wherein said motor and second clutch are operable to alternatingly rotate the second drive spool in a direction causing the compression belt to constrict around the chest of the patient, and permit the spool to spin in a direction causing the compression belt to loosen around the chest of the patient, wherein said alternate rotations of the second drive spool in the direction causing constriction and rotations of the second drive spool in the direction permitting relaxation occur while the motor is operating, a first brake and a second brake, said first brake operably connected to the first drive spool to selectively prevent rotation of the first drive spool and operably connected to the computer module whereby operation of the brake is controlled, said second brake operably connected to the second drive spool to selectively prevent rotation of the second drive spool and operably connected to the computer module whereby operation of the brake is controlled; and wherein the computer module is programmed to operate the first brake to engage the first drive spool at selected times between the constriction and loosening of the first belt while the first clutch is disengaged, and the computer module is programmed to operate the second brake to engage the second drive spool at selected times between the constriction and loosening of the second belt while the second clutch is disengaged.

2. The device of claim 1 wherein the computer module is programmed to operate the second clutch and second brake to hold the second belt in an at least partially constricted state while operating the first clutch and first drive spool to accomplish a plurality of compressions on the chest of the patient.

3. The device of claim 1 wherein the computer module is programmed to operate the second clutch and second brake to hold the second belt in constricted state after constricting operation of the second drive spool.

* * * * *